US006623245B2

(12) United States Patent
Meza et al.

(10) Patent No.: US 6,623,245 B2
(45) Date of Patent: Sep. 23, 2003

(54) PUMP AND PUMP CONTROL CIRCUIT APPARATUS AND METHOD

(75) Inventors: Humberto V. Meza, Tustin, CA (US); Congxiao Calvin Wang, Irvine, CA (US)

(73) Assignee: SHURflo Pump Manufacturing Company, Inc., Cypress, CA (US)

( * ) Notice: Subject to any disclaimer, the term of this patent is extended or adjusted under 35 U.S.C. 154(b) by 0 days.

(21) Appl. No.: 09/994,378

(22) Filed: Nov. 26, 2001

(65) Prior Publication Data

US 2003/0099548 A1 May 29, 2003

(51) Int. Cl.[7] ..... F04B 49/06

(52) U.S. Cl. ..... 417/44.1; 417/53; 417/423.14; 417/559

(58) Field of Search ..... 417/44.1, 44.2, 417/44.4, 44.11, 53, 269, 313, 472, 507, 566, 572, 25, 26, 559, 569, 423.14, 571; 137/852, 854; 91/472, 507

(56) References Cited

U.S. PATENT DOCUMENTS

| | | | | |
|---|---|---|---|---|
| 1,819,966 | A | 8/1931 | Olson | 417/269 |
| 1,982,958 | A | 12/1934 | Kraus | 74/571 |
| 2,016,802 | A | 10/1935 | Fick | 103/173 |
| 2,348,332 | A | 5/1944 | Craig et al. | 125/33 |
| 2,413,670 | A | 12/1946 | Willson | 2/119 |
| 2,462,044 | A | 2/1949 | Willson | 121/131 |
| 2,573,863 | A | 11/1951 | Mitchell | 230/20 |
| 2,677,966 | A | 5/1954 | Mueller | 74/55 |
| 2,680,412 | A | 6/1954 | Entwistle | 103/161 |

(List continued on next page.)

FOREIGN PATENT DOCUMENTS

| | | |
|---|---|---|
| DE | 509224 | 10/1930 |
| DE | 932763 | 9/1955 |
| EP | 065938 | 12/1982 |
| EP | 93674 | 11/1983 |
| EP | 744547 | 11/1996 |
| FR | 909185 | 5/1946 |
| FR | 1022273 | 3/1953 |
| FR | 1157249 | 5/1958 |
| FR | 2 703 409 A1 * | 10/1994 |
| GB | 468122 | 6/1937 |
| GB | 654636 | 6/1951 |
| GB | 1263057 | 9/1972 |
| IT | 585940 | 11/1958 |
| IT | 644086 | 8/1962 |
| JP | 404255593 | 9/1992 |

OTHER PUBLICATIONS

Product Information Sheet, "550 Series Super Flow Pump", Aquatec Water Systems, Inc., Mar. 22, 2001.

SHURflo Brochure, "Value Assembly Replacement Model 2XX/21XX", 10/81.

*Primary Examiner*—Charles G. Freay
*Assistant Examiner*—Han L Liu
(74) *Attorney, Agent, or Firm*—Michael Best & Friedrich LLP

(57) ABSTRACT

A method and apparatus for a pump and a pump control system. The apparatus includes pistons integrally formed in a diaphragm and coupled to the diaphragm by convolutes. The convolutes have a bottom surface angled with respect to a top surface of the pistons. The apparatus also includes an outlet port positioned tangentially with respect to the perimeter of an outlet chamber. The apparatus further includes a non-mechanical pressure sensor coupled to a pump control system. For the method of the invention, the microcontroller provides a pulse-width modulation control signal to an output power stage in order to selectively control the power provided to the pump. The control signal is based on the pressure within the pump, the current being provided to the pump, and the voltage level of the battery.

63 Claims, 25 Drawing Sheets

U.S. PATENT DOCUMENTS

| | | | | | |
|---|---|---|---|---|---|
| 2,797,647 | A | | 7/1957 | Floraday | 103/173 |
| 2,926,735 | A | | 3/1960 | Cook | 180/42 |
| 2,929,333 | A | | 3/1960 | Harry | 103/150 |
| 2,931,311 | A | | 4/1960 | Ulm et al. | 103/150 |
| 2,942,550 | A | | 6/1960 | Carter | 103/42 |
| 2,969,745 | A | | 1/1961 | Johnson et al. | 103/150 |
| 2,971,470 | A | | 2/1961 | Wein et al. | 103/150 |
| 3,010,339 | A | | 3/1961 | Brock | 74/568 |
| 2,991,723 | A | | 7/1961 | Zubaty | 103/150 |
| 3,010,403 | A | | 11/1961 | Zubaty | 103/150 |
| 3,077,118 | A | | 2/1963 | Robbins | 74/60 |
| 3,095,824 | A | | 7/1963 | Elfes | 103/152 |
| 3,199,531 | A | | 8/1965 | Cornelius et al. | 137/394 |
| 3,205,829 | A | | 9/1965 | Andersen et al. | 103/150 |
| 3,304,886 | A | | 2/1967 | Roberts | 103/173 |
| 3,314,600 | A | | 4/1967 | Hadley | 230/172 |
| 3,410,477 | A | | 11/1968 | Hartley | 230/185 |
| 3,496,872 | A | | 2/1970 | Reister et al. | 103/23 |
| 3,552,886 | A | | 1/1971 | Olson, Jr. | 417/269 |
| 3,572,375 | A | | 3/1971 | Rosenberg | 137/512 |
| 3,572,980 | A | | 3/1971 | Hollyday | 417/413 |
| 3,606,597 | A | | 9/1971 | Russell | 417/542 |
| 3,684,406 | A | | 8/1972 | Edwards | 417/454 |
| 3,698,287 | A | | 10/1972 | Martin | 91/507 |
| 3,712,759 | A | | 1/1973 | Olson, Jr. | 417/269 |
| 3,754,842 | A | | 8/1973 | Schlanzky | 417/269 |
| 3,781,925 | A | | 1/1974 | Curtis et al. | 4/172.15 |
| 3,834,840 | A | | 9/1974 | Hartley | 417/535 |
| 3,941,519 | A | | 3/1976 | McCauley | 417/560 |
| 3,973,471 | A | | 8/1976 | Hirmann | 91/472 |
| 4,153,391 | A | | 5/1979 | Hartley | 417/269 |
| 4,242,061 | A | | 12/1980 | Hartley | 417/536 |
| 4,305,702 | A | | 12/1981 | Hartley | 417/413 |
| 4,322,297 | A | | 3/1982 | Bajka | 210/742 |
| 4,396,357 | A | | 8/1983 | Hartley | 417/269 |
| 4,428,688 | A | | 1/1984 | McGregor, Jr. | 384/208 |
| 4,486,151 | A | | 12/1984 | Korhonen-Wesala | 417/222 |
| 4,507,058 | A | | 3/1985 | Schoenmeyr | 417/270 |
| 4,515,531 | A | | 5/1985 | Roser | 417/269 |
| 4,545,735 | A | | 10/1985 | Ims | 417/307 |
| 4,550,749 | A | | 11/1985 | Krikorian | 137/843 |
| 4,610,605 | A | * | 9/1986 | Hartley | 417/269 |
| 4,611,529 | A | | 9/1986 | Stricker et al. | 91/499 |
| 4,646,781 | A | | 3/1987 | McIntyre et al. | 137/512.4 |
| 4,678,409 | A | * | 7/1987 | Kurokawa | 417/420 |
| 4,711,224 | A | | 12/1987 | Eckhardt | 123/572 |
| 4,738,185 | A | | 4/1988 | Kamimura | 91/507 |
| 4,743,169 | A | | 5/1988 | Funakawa et al. | 417/306 |
| 4,776,776 | A | | 10/1988 | Jones | 417/560 |
| 4,797,069 | A | | 1/1989 | Hartley et al. | 417/222 |
| 5,004,535 | A | | 4/1991 | Bosko et al. | 210/90 |
| 5,099,181 | A | * | 3/1992 | Canon | 318/254 |
| 5,129,794 | A | | 7/1992 | Beatty | 417/413 |
| 5,203,803 | A | | 4/1993 | Schoenmeyr | 417/38 |
| 5,261,792 | A | | 11/1993 | Schoenmeyr | 417/38 |
| 5,301,663 | A | | 4/1994 | Small, Jr. | 128/200.18 |
| 5,316,447 | A | | 5/1994 | Fujii et al. | 417/269 |
| 5,325,885 | A | | 7/1994 | Ivan et al. | 137/217 |
| 5,332,944 | A | | 7/1994 | Cline | 310/339 |
| 5,344,292 | A | | 9/1994 | Rabenau et al. | 417/413 R |
| 5,410,150 | A | | 4/1995 | Teron et al. | 250/227.22 |
| 5,476,367 | A | | 12/1995 | Zimmermann et al. | 417/307 |
| 5,503,736 | A | | 4/1996 | Schoenmeyr | 210/91 |
| 5,520,517 | A | * | 5/1996 | Sipin | 417/44.3 |
| D371,293 | S | | 7/1996 | Schoenmeyr | D8/354 |
| D373,365 | S | | 9/1996 | Schoenmeyr | D15/7 |
| 5,571,000 | A | * | 11/1996 | Zimmermann et al. | 417/307 |
| 5,585,025 | A | | 12/1996 | Idland | 219/497 |
| 5,601,112 | A | | 2/1997 | Sekiya et al. | 137/512.15 |
| 5,602,670 | A | | 2/1997 | Keegan | 359/193 |
| 5,613,838 | A | | 3/1997 | Newell | 417/269 |
| 5,615,597 | A | | 4/1997 | Schoenmeyr | 92/103 SD |
| 5,626,464 | A | * | 5/1997 | Schoenmeyr et al. | 417/269 |
| 5,632,468 | A | | 5/1997 | Schoenmeyr | 251/129.15 |
| 5,649,812 | A | | 7/1997 | Schoenmeyr et al. | 417/363 |
| 5,658,457 | A | | 8/1997 | Schoenmeyr | 210/97 |
| 5,690,476 | A | | 11/1997 | Miller | 417/44.2 |
| 5,706,715 | A | | 1/1998 | Schoenmeyr | 92/103 SD |
| 5,725,359 | A | | 3/1998 | Dongo et al. | 417/44.9 |
| 5,730,861 | A | | 3/1998 | Sterghos et al. | 210/86 |
| 5,791,882 | A | * | 8/1998 | Stucker et al. | 417/269 |
| 5,803,711 | A | | 9/1998 | Schoenmeyr | 417/36 |
| 5,809,796 | A | | 9/1998 | Zakryk | 62/238.6 |
| 5,816,133 | A | | 10/1998 | Schoenmeyr | 92/128 |
| 5,860,449 | A | | 1/1999 | Schulte | 137/550 |
| 5,898,958 | A | | 5/1999 | Hall | 4/541.1 |
| 6,003,166 | A | | 12/1999 | Hald et al. | 4/541.1 |
| 6,048,183 | A | * | 4/2000 | Meza | 417/569 |
| 6,059,536 | A | | 5/2000 | Stingl | 417/44.2 |
| 6,089,838 | A | | 7/2000 | Schoenmeyr et al. | 417/572 |
| 6,099,264 | A | | 8/2000 | Du | 417/300 |
| D441,767 | S | | 5/2001 | Wolbers | D15/7 |
| 6,227,808 | B1 | | 5/2001 | McDonough | 417/44.2 |
| 6,254,353 | B1 | * | 7/2001 | Polo et al. | 417/44.11 |
| 6,299,414 | B1 | * | 10/2001 | Schoenmeyr | 417/244 |

* cited by examiner

PUMP AND PUMP CONTROL CIRCUIT APPARATUS AND METHOD

FIELD OF THE INVENTION

This invention relates generally to pumps and pumping methods, and more particularly to wobble plate pumps and pump controls.

BACKGROUND OF THE INVENTION

Wobble-plate pumps are employed in a number of different applications and operate under well-known principals. In general, wobble-plate pumps typically include pistons that move in a reciprocating manner within corresponding pump chambers. In many cases, the pistons are moved by a cam surface of a wobble plate that is rotated by a motor or other driving device. The reciprocating movement of the pistons pumps fluid from an inlet port to an outlet port of the pump.

In many conventional wobble plate pumps, the pistons of the pump are coupled to a flexible diaphragm that is positioned between the wobble plate and the pump chambers. In such pumps, each one of the pistons is an individual component separate from the diaphragm, requiring numerous components to be manufactured and assembled. A convolute is sometimes employed to connect each piston and the diaphragm so that the pistons can reciprocate and move with respect to the remainder of the diaphragm. Normally, the thickness of each portion of the convolute must be precisely designed for maximum pump efficiency without risking rupture of the diaphragm.

Many conventional pumps (including wobble plate pumps) have an outlet port coupled to an outlet chamber located within the pump and which is in communication with each of the pump chambers. The outlet port is conventionally positioned radially away from the outlet chamber. As the fluid is pumped out of each of the pump chambers sequentially, the fluid enters the outlet chamber and flows along a circular path. However, in order to exit the outlet chamber through the outlet port, the fluid must diverge at a relatively sharp angle from the circular path. When the fluid is forced to diverge from the circular path, the efficiency of the pump is reduced, especially at lower pressures and higher flow rates.

Many conventional pumps include a mechanical pressure switch that shuts off the pump when a certain pressure (i.e., the shut-off pressure) is exceeded. The pressure switch is typically positioned in physical communication with the fluid in the pump. When the pressure of the fluid exceeds the shut-off pressure, the force of the fluid moves the mechanical switch to open the pump's power circuit. Mechanical pressure switches have several limitations. For example, during the repeated opening and closing of the pump's power circuit, arcing and scorching often occurs between the contacts of the switch. Due to this arcing and scorching, an oxidation layer forms over the contacts of the switch, and the switch will eventually be unable to close the pump's power circuit. In addition, most conventional mechanical pressure switches are unable to operate at high frequencies, which results in the pump being completely "on" or completely "off." The repeated cycling between completely "on" and completely "off" results in louder operation. Moreover, since mechanical switches are either completely "on" or completely "off," mechanical switches are unable to precisely control the power provided to the pump.

Wobble-plate pumps are often designed to be powered by a battery, such as an automotive battery. In the pump embodiments employing a pressure switch as described above, power from the battery is normally provided to the pump depending upon whether the mechanical pressure switch is open or closed. If the switch is closed, full battery power is provided to the pump. Always providing full battery power to the pump can cause voltage surge problems when the battery is being charged (e.g., when an automotive battery in a recreational vehicle is being charged by another automotive battery in another operating vehicle). Voltage surges that occur while the battery is being charged can damage the components of the pump. Conversely, voltage drop problems can result if the battery cannot be mounted in close proximity to the pump (e.g., when an automotive battery is positioned adjacent to a recreational vehicle's engine and the pump is mounted in the rear of the recreational vehicle). Also, the voltage level of the battery drops as the battery is drained from use. If the voltage level provided to the pump by the battery becomes too low, the pump may stall at pressures less than the shut-off pressure. Moreover, when the pump stalls at pressures less than the shut-off pressure, current is still being provided to the pump's motor even through the motor is unable to turn. If the current provided to the pump's motor becomes too high, the components of the pump's motor can be damaged.

In light of the problems and limitations described above, a need exists for a pump apparatus and method employing a diaphragm that is easy to manufacture and is reliable (whether having integral pistons or otherwise). A need also exists for a pump having an outlet port that is positioned for improved fluid flow from the pump outlet port. Furthermore, a need further exists for a pump control system designed to better control the power provided to the pump, to provide for quiet operation of the pump, and to prevent voltage surges, voltage drops, and excessive currents from damaging the pump. Each embodiment of the present invention achieves one or more of these results.

SUMMARY OF THE INVENTION

Some preferred embodiments of the present invention provide a diaphragm for use with a pump having pistons driving the diaphragm to pump fluid through the pump. The pistons can be integrally formed in a body portion of the diaphragm, thereby resulting in fewer components for the manufacture and assembly of the pump. Also, each of the pistons are preferably coupled (i.e., attached to or integral therewith) to the body portion of the diaphragm by a convolute. Each of the pistons can have a top surface lying generally in a single plane. In some embodiments, each convolute is comprised of more material at its outer perimeter so that the bottom surface of each convolute lies at an angle with respect to the plane of the piston top surfaces. The angled bottom surface of the convolutes allows the pistons a greater range of motion with respect to the outer perimeter of the convolute, and results in reduced diaphragm stresses for longer diaphragm life.

In some preferred embodiments of the present invention, an outlet port of the pump is positioned tangentially with respect to the perimeter of an outlet chamber. The tangential outlet port allows fluid flowing in a circular path within the outlet chamber to continue along the circular path as the fluid exits the outlet chamber. This results in better pump efficiency, especially at lower pressures and higher flow rates.

Some preferred embodiments of the present invention further provide a pump having a non-mechanical pressure sensor coupled to a pump control system. Preferably, the pressure sensor provides a signal representative of the changes in pressure within the pump to a microcontroller within the pump control system. Based upon the sensed pressure, the microcontroller can provide a pulse-width modulation control signal to an output power stage coupled to the pump. The output power stage selectively provides power to the pump based upon the control signal. Preferably, due to the pulse-width modulation control signal, the speed of the pump gradually increases or decreases rather than cycling between completely "on" and completely "off," resulting in more efficient and quieter operation of the pump.

The pump control system can also include an input power stage designed to be coupled to a battery. The microcontroller is coupled to the input power stage in order to sense the voltage level of the battery. If the battery voltage is above a high threshold (e.g., when the battery is being charged), the microcontroller preferably prevents power from being provided to the pump. If the battery voltage is below a low threshold (e.g., when the voltage available from the battery will allow the pump to stall below the shut-off pressure), the microcontroller preferably also prevents power from being provided to the pump. In some preferred embodiments, the microprocessor only generates a control signal if the sensed battery voltage is less than the high threshold and greater than the low threshold.

Preferably, the pump control system is also capable of adjusting the pump's shut-off pressure based upon the sensed battery voltage in order to prevent the pump from stalling when the battery is not fully charged. The microprocessor compares the sensed pressure to the adjusted shut-off pressure. If the sensed pressure is less than the adjusted shut-off pressure, the microprocessor generates a high control signal so that the output power stage provides power to the pump. If the sensed pressure is greater than the adjusted shut-off pressure, the microprocessor generates a low control signal so that the output power stage does not provide power to the pump.

In some preferred embodiments, the pump control system is further capable of limiting the current provided to the pump in order to prevent high currents from damaging the pump's components. The pump control system is capable of adjusting a current limit threshold based upon the sensed pressure of the fluid within the pump. The pump control system can include a current-sensing circuit capable of sensing the current being provided to the pump. If the sensed current is less than the current limit threshold, the microcontroller preferably generates a high control signal so that the output power stage provides power to the pump. If the sensed current is greater than the current limit threshold, the microcontroller preferably generates a low control signal until the sensed current is less than the current limit threshold.

For the method of the invention, the microcontroller preferably senses the voltage level of the battery and determines whether the voltage level is between a high threshold and a low threshold. Preferably, the microcontroller only allows the pump to operate if the voltage level of the battery is between the high threshold and the low threshold. The microprocessor adjusts the shut-off pressure for the pump based on the sensed voltage.

Preferably, the microcontroller can also sense the pressure of the fluid within the pump and can determine whether the pressure is greater than the adjusted shut-off pressure. If the sensed pressure is greater than the shut-off pressure, the microprocessor preferably generates a pulse-width modulation control signal in order to provide less power to the pump. If the sensed pressure is less than the shut-off pressure, the microprocessor preferably determines whether the pump is turned off. If the pump is not turned off, the microprocessor generates a pulse-width modulation control signal in order to provide more power to the pump.

If the sensed pressure is less than the shut-off pressure and the pump is turned off, the microprocessor preferably generates a pulse-width modulation control signal to re-start the pump. The microcontroller senses the pressure of the fluid within the pump and adjusts the current limit threshold based on the sensed pressure. The microcontroller senses the current being provided to the pump. If the sensed current is greater than the current limit threshold, the microcontroller preferably generates a pulse-width modulation control signal in order to provide less power to the pump. If the sensed current is less than the current limit threshold, the microcontroller preferably generates a pulse-width modulation control signal in order to provide more power to the pump.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
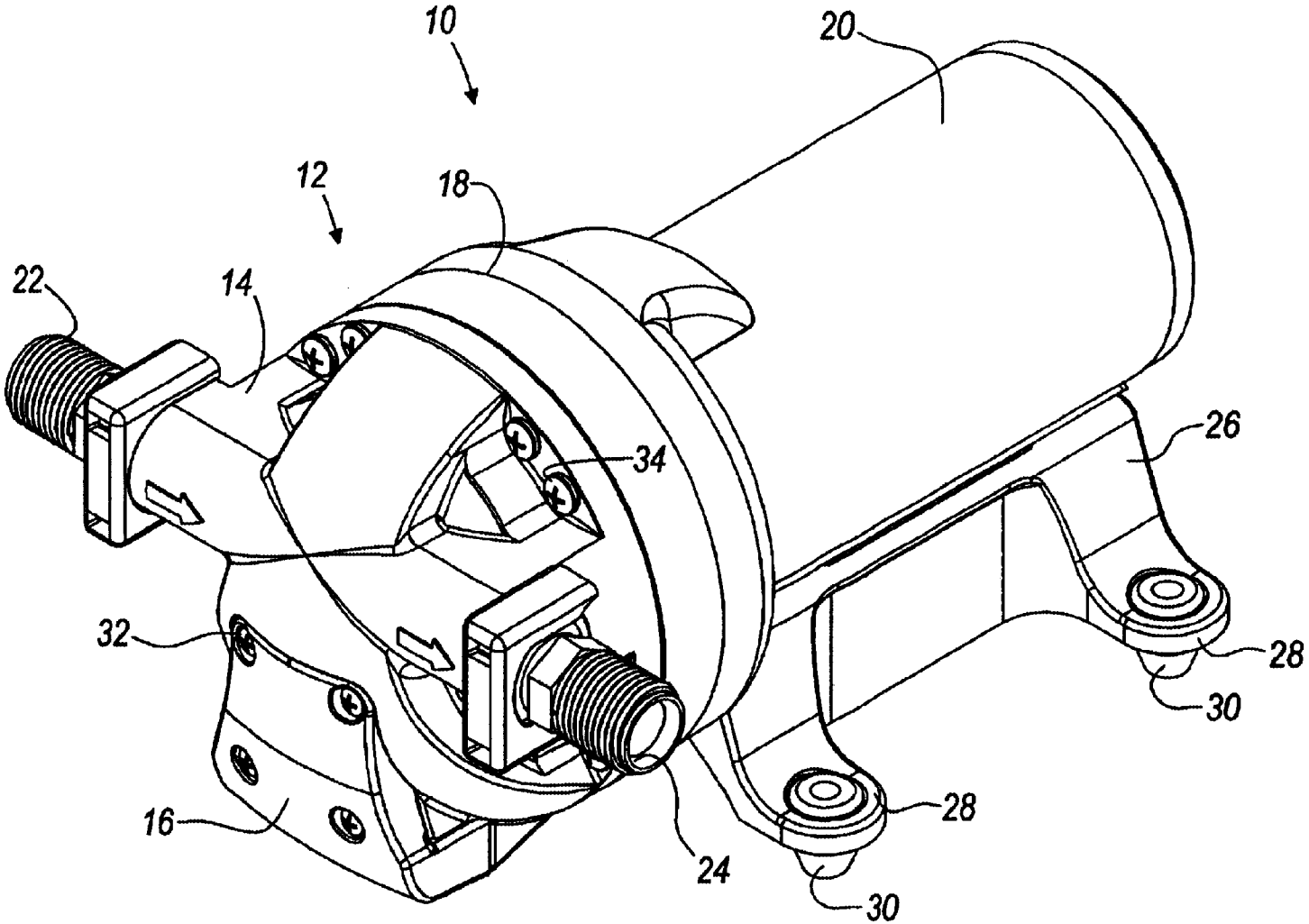
FIG. 1 is a perspective view of a pump according to a preferred embodiment of the present invention.
Figure 2:
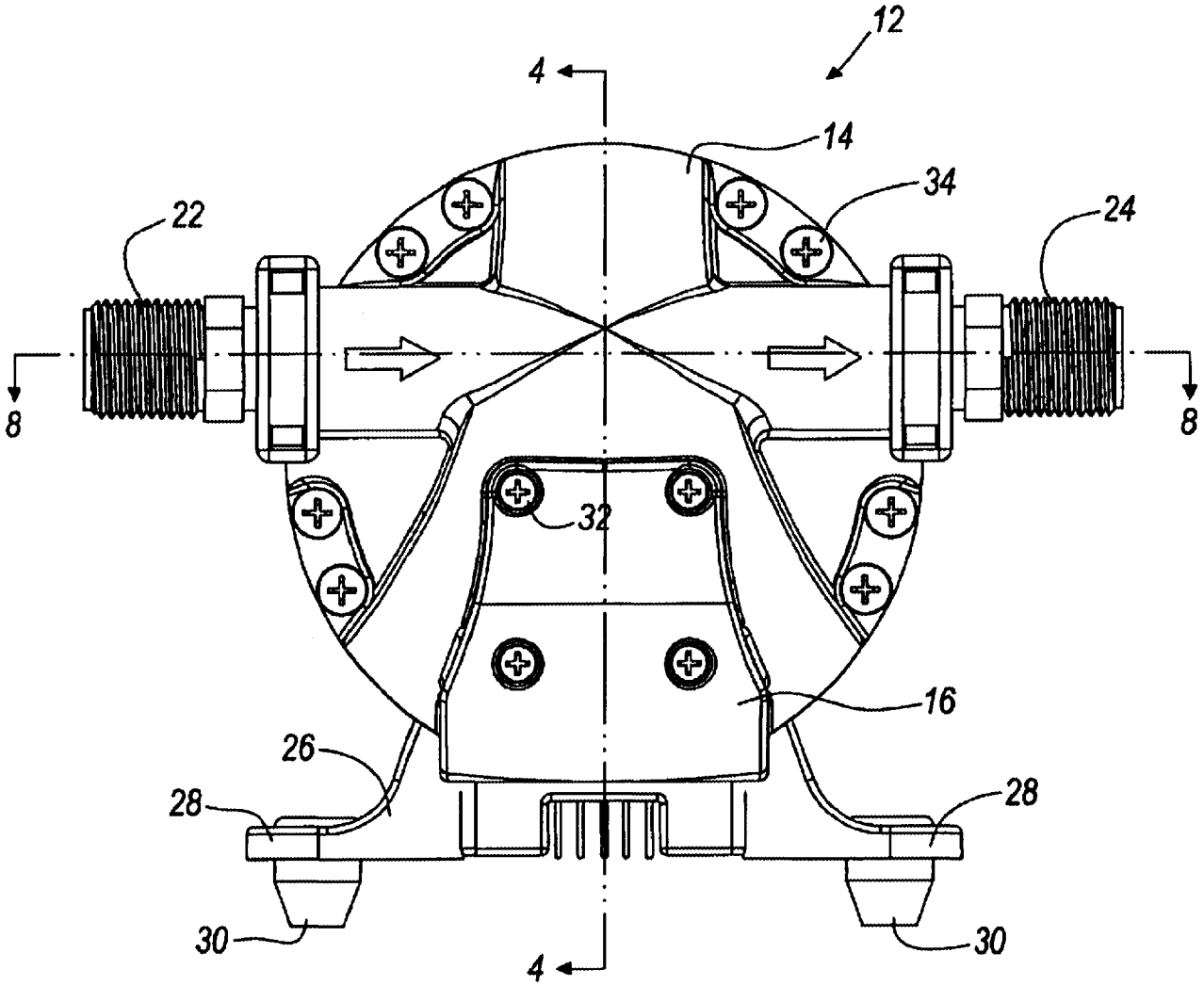
FIG. 2 is a front view of the pump illustrated in FIG. 1.
Figure 3:
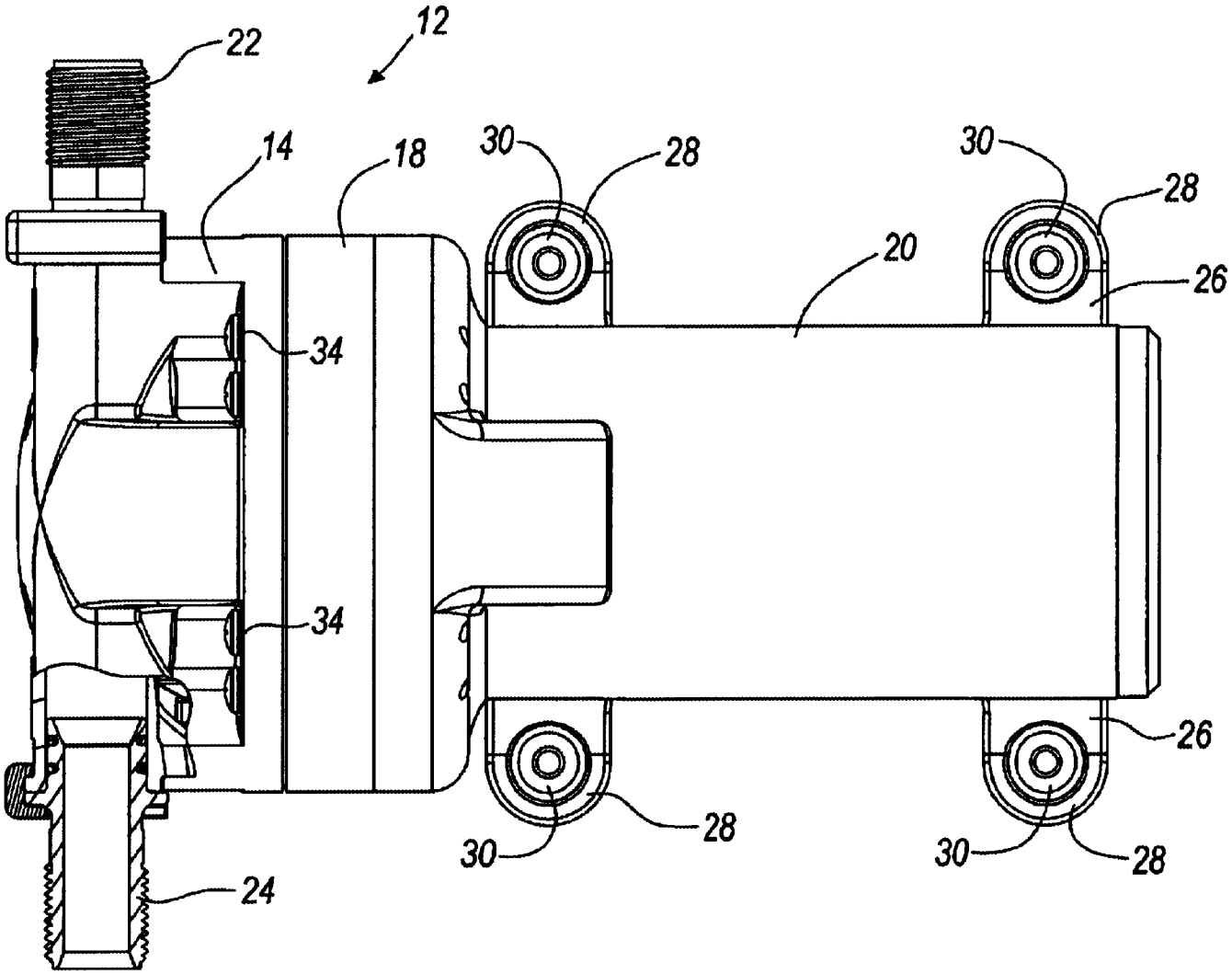
FIG. 3 is a top view of the pump illustrated in FIGS. 1 and 2.

FIGS. 1–3 illustrate the exterior of a pump 10 according to a preferred embodiment of the present invention. In some preferred embodiments such as that shown in the figures, the pump 10 includes a pump head assembly 12 having a front housing 14, a sensor housing 16 coupled to the front housing 14 via screws 32, and a rear housing 18 coupled to the front housing 14 via screws 34. Although screws 32, 34 are preferably employed to connect the sensor housing 16 and rear housing 18 to the front housing 14 as just described, any other type of fastener can instead be used (including without limitation bolt and nut sets or other threaded fasteners, rivets, clamps, buckles, and the like). It should also be noted that reference herein and in the appended claims to terms of orientation (such as front and rear) are provided for purposes of illustration only and are not intended as limitations upon the present invention. The pump 10 and various elements of the pump 10 can be oriented in any manner desired while still falling within the spirit and scope of the present invention.

The pump 10 is preferably connected or connectable to a motor assembly 20, and can be connected thereto in any conventional manner such as those described above with reference to the connection between the front and rear housings 14, 18. The pump 10 and motor assembly 20 can have a pedestal 26 with legs 28 adapted to support the weight of the pump 10 and motor assembly 20. Alternatively, the pump 10 and/or motor assembly 20 can have or be connected to a bracket, stand, or any other device for mounting and supporting the pump 10 and motor assembly 20 upon a surface in any orientation. Preferably, the legs 28 each include cushions 30 constructed of a resilient material (such as rubber, urethane, and the like), so that vibration from the pump 10 to the surrounding environment is reduced.

The front housing 14 preferably includes an inlet port 22 and an outlet port 24. Preferably, the inlet port 22 is connected to an inlet fluid line (not shown) and the outlet port 24 is connected to an outlet fluid line (not shown). The inlet port 22 and the outlet port 24 are each preferably provided with fittings for connection to inlet and outlet fluid lines (not shown). Most preferably, the inlet port 22 and outlet port 24 are provided with quick disconnect fittings, although threaded ports can instead be used as desired. Alternatively, any other type of conventional fluid line connector can instead be used, including compression fittings, swage fittings, and the like. In some preferred embodiments of the present invention, the inlet and outlet ports are provided with at least one (and more preferably two) gaskets, O-rings, or other seals to help prevent inlet and outlet port leakage.

The pump head assembly 12 preferably has front and rear housing portions 14, 18 as illustrated in the figures. Alternatively, the pump head assembly 12 can have any number of body portions connected together in any manner (including the manners of connection described above with reference to the connection between the front and rear housing portions 14, 18). In this regard, it should be noted that the housing of the pump head assembly 12 can be defined by housing portions arranged in any other manner, such as by left and right housing portions, upper and lower housing portions, multiple housing portions connected together in various manners, and the like. Accordingly, the inlet and outlet ports 22, 24 of the pump head assembly 12 and the inlet and outlet chambers 92, 94 (described in greater detail below) can be located in other portions of the pump housing determined at least partially upon the shape and size of the housing portions 14, 18 and upon the positional relationship of the inlet and outlet ports 22, 24 and the inlet and outlet chambers 92, 94 to components within the pump head assembly 12 (described in greater detail below).

Figure 4:
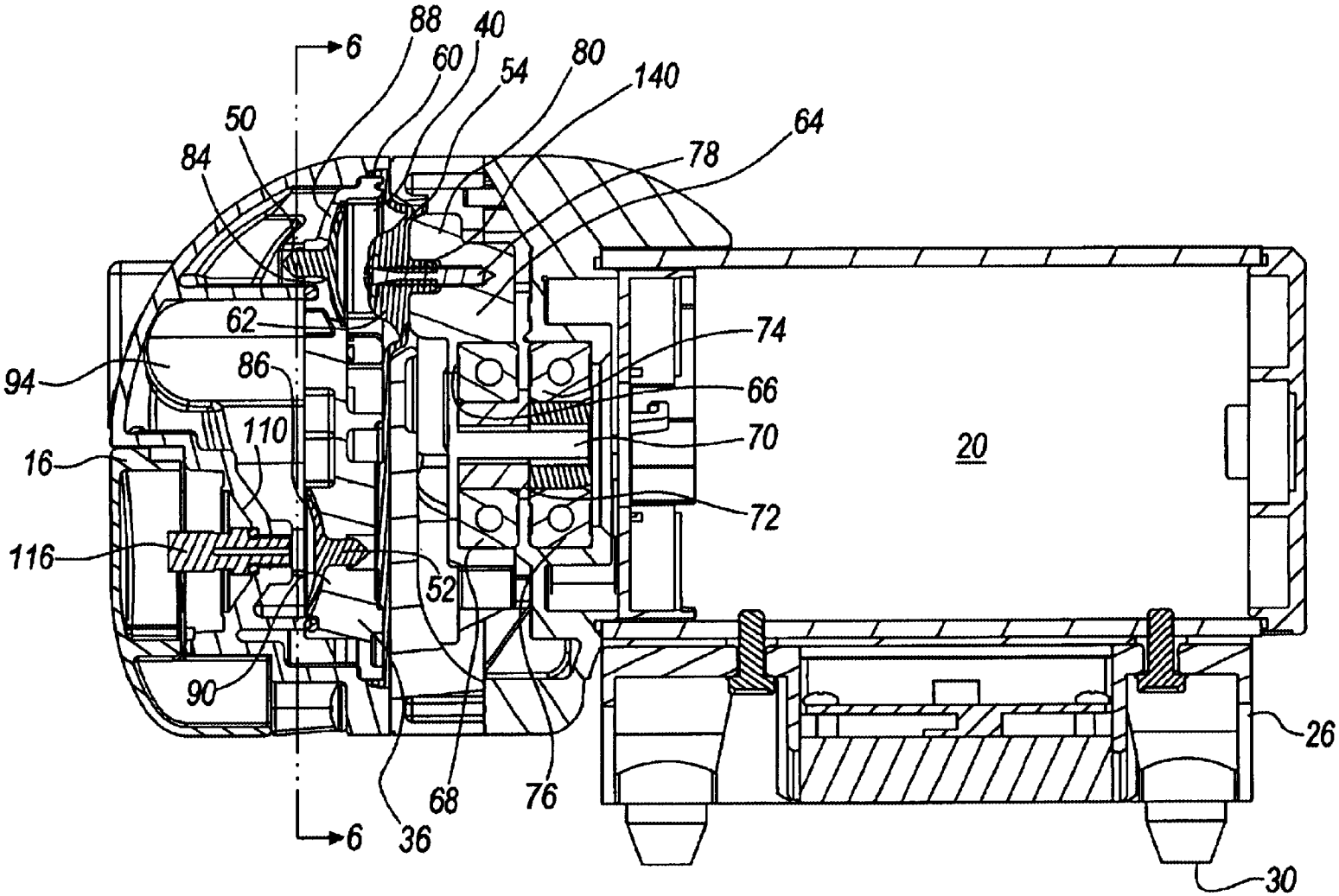
FIG. 4 is a cross-sectional view of the pump illustrated in FIGS. 1–3, taken along line 4—4 of FIG. 2.
Figure 5:
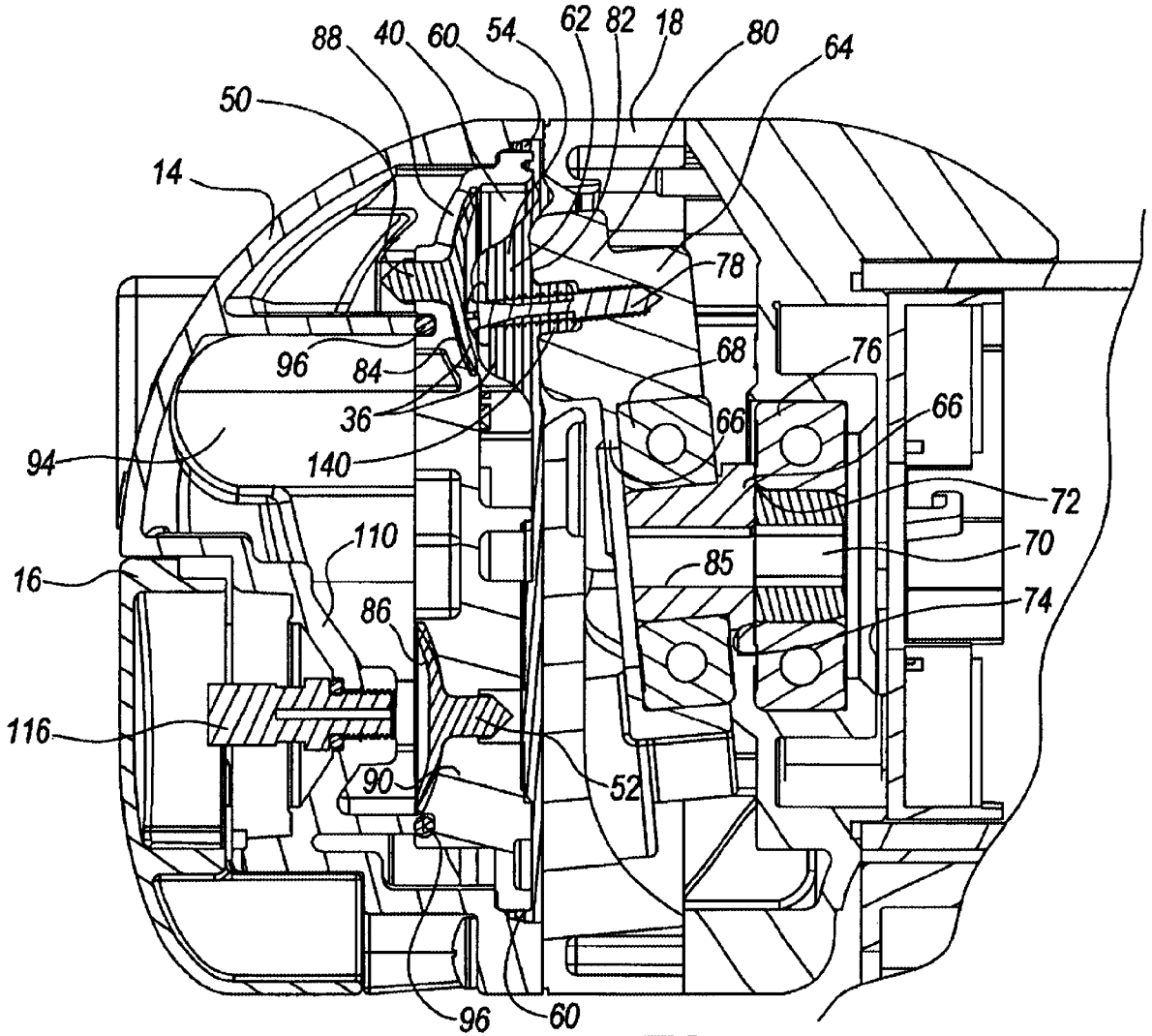
FIG. 5 is a detail view of FIG. 4.
Figure 6:
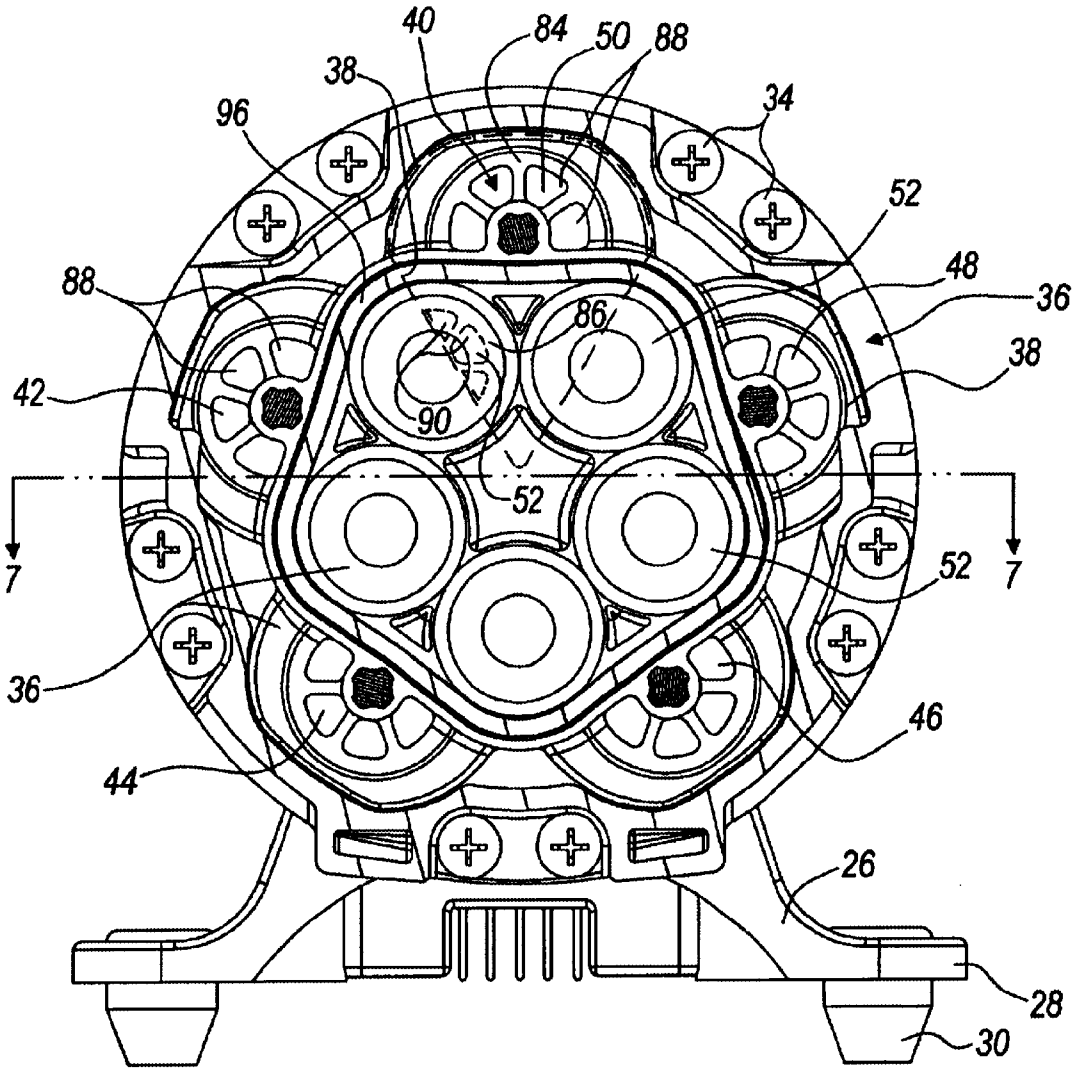
FIG. 6 is cross-sectional view of the pump illustrated in FIGS. 1–5, taken along line 6—6 of FIG. 4.
Figure 7:
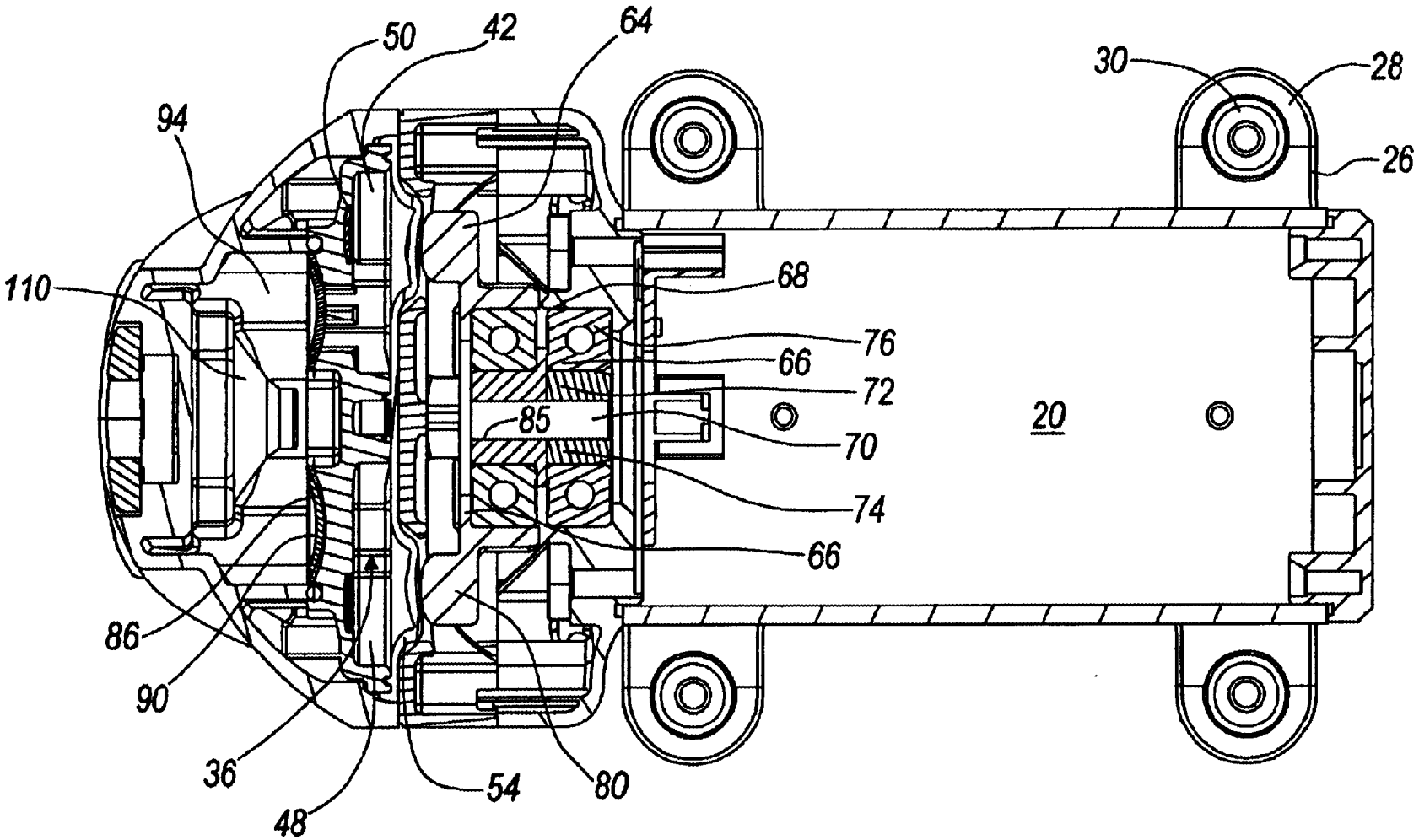
FIG. 7 is a cross-sectional view of the pump illustrated in FIGS. 1–6, taken along line 7—7 of FIG. 6.

FIGS. 4–9 illustrate various aspects of the interior of the pump 10 according to one preferred embodiment of the present invention. A valve assembly 36 is preferably coupled between the front housing 14 and the rear housing 18. As best shown in FIG. 6, the valve assembly 36 defines one or more chambers 38 within the pump 10. In FIG. 6, the shape of one of the chambers 38 (located on the reverse side of the valve assembly 36 as viewed in FIG. 6) is shown in dashed lines. The chambers 38 in the pump 10 are preferably tear-drop shaped as shown in the figures, but can take any other shape desired, including without limitation round, rectangular, elongated, and irregular shapes.

In some preferred embodiments, the pump 10 includes five chambers 38, namely a first chamber 40, a second chamber 42, a third chamber 44, a fourth chamber 46, and a fifth chamber 48. Although the pump 10 is described herein as having five chambers 38, the pump 10 can have any number of chambers 38, such as two chambers 38, three chambers 38, or six chambers 38.

For each one of the chambers 38, the valve assembly 36 preferably includes an inlet valve 50 and an outlet valve 52. Preferably, the inlet valve 50 is positioned within an inlet valve seat 84 defined by the valve assembly 36 within each one of the chambers 38, while the outlet valve 52 is positioned within an outlet valve seat 86 defined by the valve assembly 36 corresponding to each one of the chambers 38. The inlet valve 50 is preferably positioned within the inlet valve seat 84 so that fluid is allowed to enter the chamber 38 through inlet apertures 88, but fluid cannot exit the chamber 38 through inlet apertures 88. Conversely, the outlet valve 52 is preferably positioned within the outlet valve seat 86 so that fluid is allowed to exit the chamber 38 through outlet apertures 90, but fluid cannot enter the chamber 38 through outlet apertures 90. With reference to FIG. 6, fluid therefore enters each chamber 38 through inlet apertures 88 (i.e., into the plane of the page) of a one-way inlet valve 50, and exits each chamber 38 through outlet apertures 90 (i.e., out of the plane of the page) of a one-way outlet valve 52. The valves 50, 52 are conventional in nature and in the illustrated preferred embodiment are disc-shaped flexible elements secured within the valve seats 84, 86 by a snap fit connection between a headed extension of each valve 50, 52 into a central aperture in a corresponding valve seat 84, 86.

Figure 8:
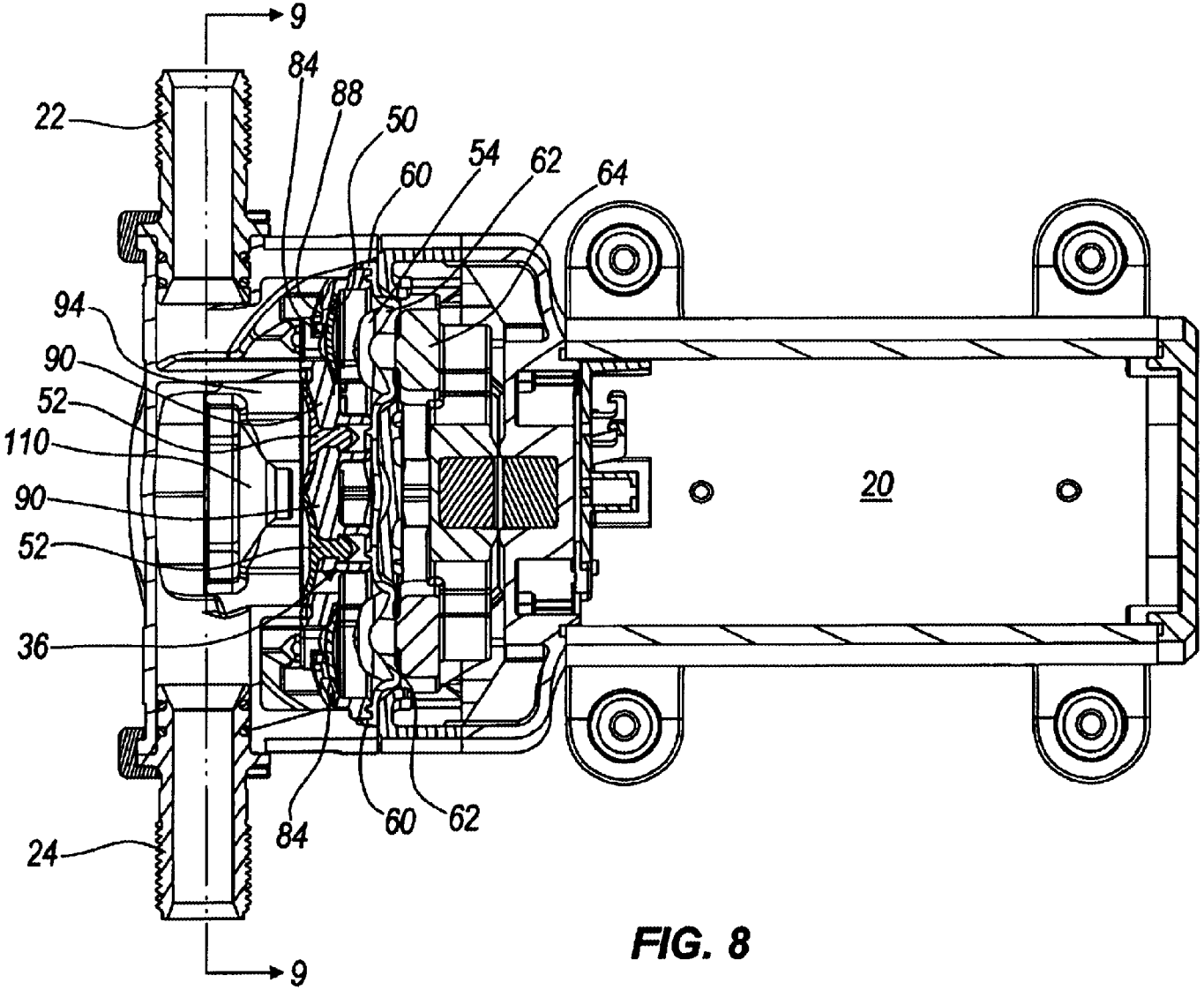
FIG. 8 is a cross-sectional view of the pump illustrated in FIGS. 1–7, taken along line 8—8 of FIG. 2.
Figure 9:
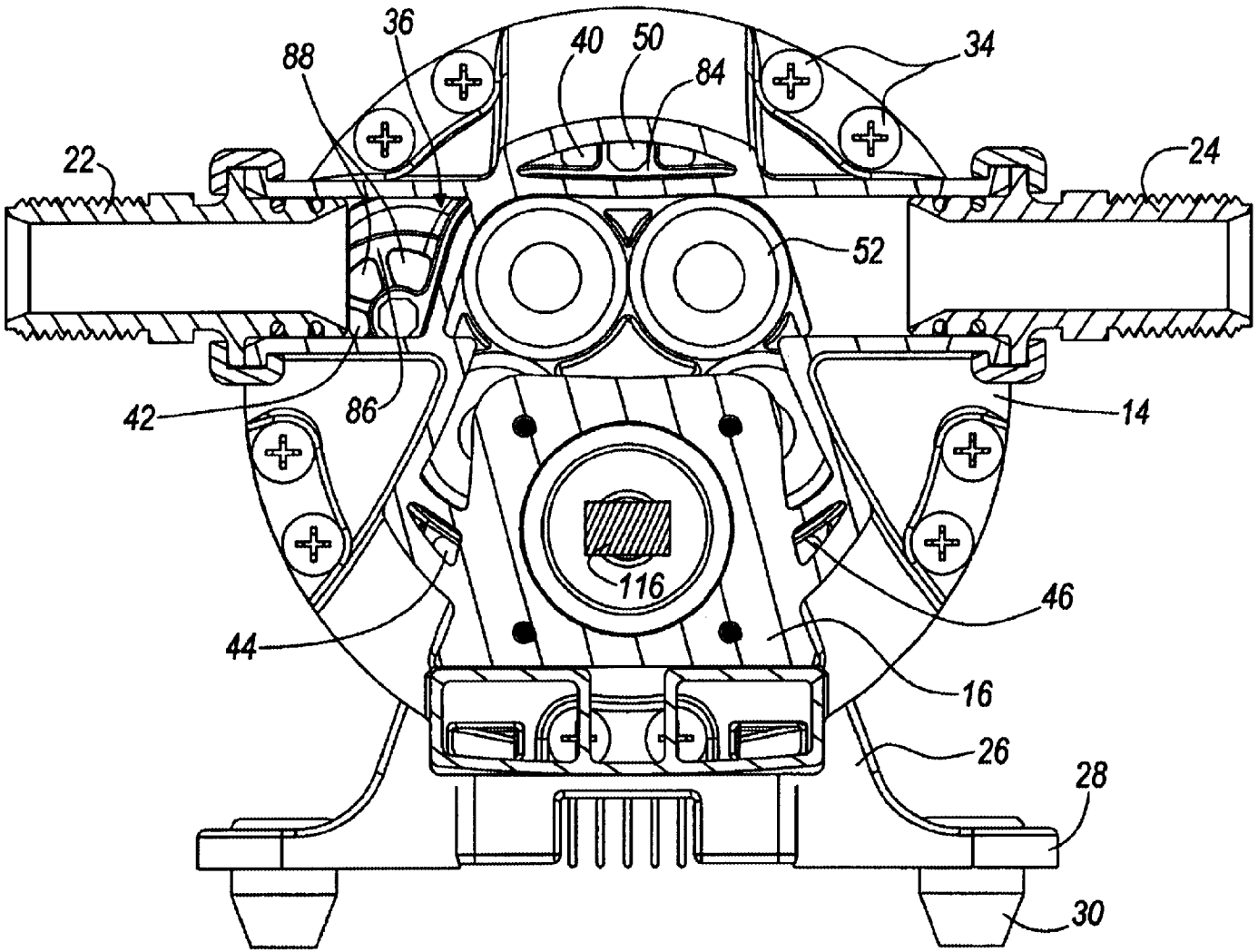
FIG. 9 is a cross-sectional view of the pump illustrated in FIGS. 1–8, taken along line 9—9 of FIG. 8.
Figure 10A:
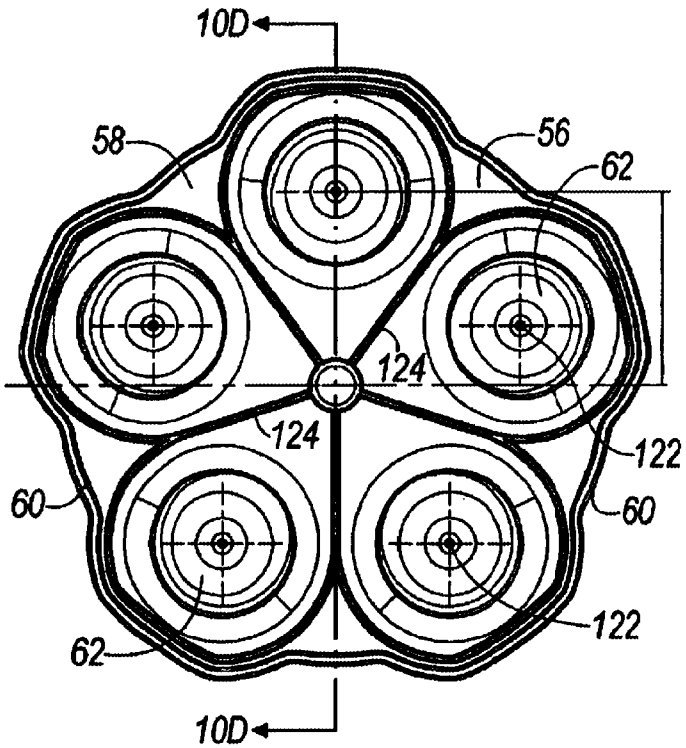
FIGS. 10A–10E illustrate a pump diaphragm according to a preferred embodiment of the present invention.
Figure 10C:
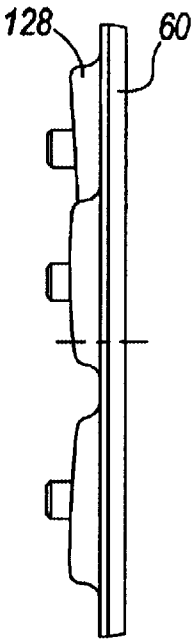
Figure 10B:
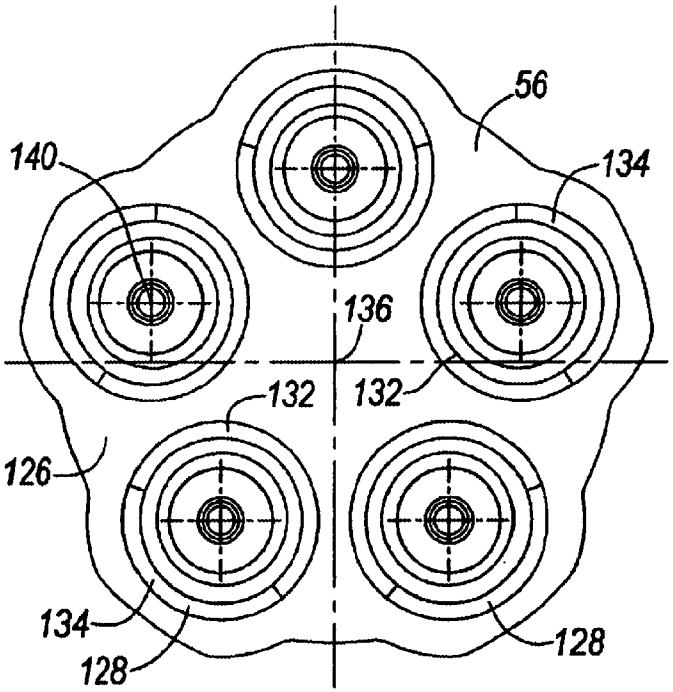
Figure 10D:
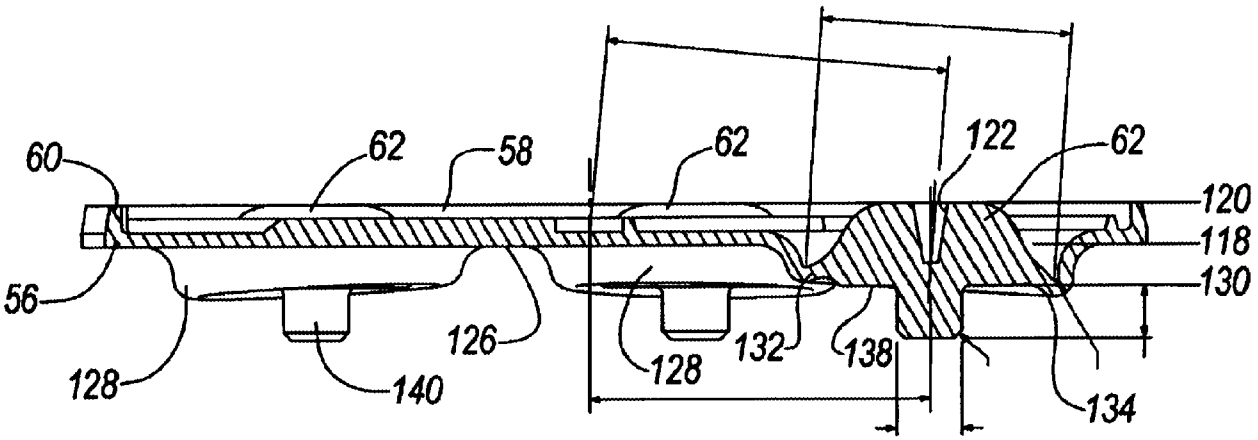
Figure 10E:
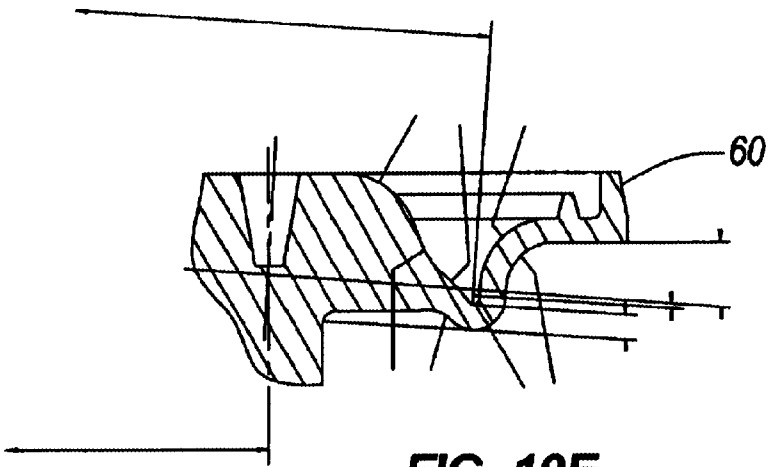

As best shown in FIGS. 4, 5, and 8, a diaphragm 54 is preferably located between the valve assembly 36 and the rear housing 18. Movement of the diaphragm 54 causes fluid in the pump 10 to move as described above through the valves 50, 52. With reference again to FIG. 6, the diaphragm 54 in the illustrated preferred embodiment is located over the valves 50, 52 shown in FIG. 6. The diaphragm 54 is preferably positioned into a sealing relationship with the valve assembly 36 (e.g., over the valves 50, 52 as just described) via a lip 60 that extends around the perimeter of the diaphragm 54. Preferably, the diaphragm 54 includes one or more pistons 62 corresponding to each one of the chambers 38. The diaphragm 54 in the illustrated preferred embodiment has one piston 62 corresponding to each chamber 38.

The pistons 62 are preferably connected to a wobble plate 66 so that the pistons 62 are actuated by movement of the wobble plate 66. Any wobble plate arrangement and connection can be employed to actuate the pistons 62 of the diaphragm 54. In the illustrated preferred embodiment, the wobble plate 66 has a plurality of rocker arms 64 that transmit force from the center of the wobble plate 66 to locations adjacent to the pistons 62. Any number of rocker arms 64 can be employed for driving the pistons 62, depending at least partially upon the number and arrangement of the pistons 62. Although any rocker arm shape can be employed, the rocker arms 64 in the illustrated preferred embodiment have extensions 80 extending from the ends of the rocker arms 64 to the pistons 62 of the diaphragm 54. The pistons 62 of the diaphragm 54 are preferably connected to the rocker arms, and can be connected to the extensions 80 of the rocker arms 64 in those embodiments having such extensions 80. Preferably, the center of each piston 62 is secured to a corresponding rocker arm extension 80 via a screw 78. The pistons 62 can instead be attached to the wobble plate 66 in any other manner, such as by nut and bolt sets, other threaded fasteners, rivets, by adhesive or cohesive bonding material, by snap-fit connections, and the like.

The rocker arm 64 is preferably coupled to a wobble plate 66 by a first bearing assembly 68, and can be coupled to a rotating output shaft 70 of the motor assembly 20 in any conventional manner. In the illustrated preferred embodiment, the wobble plate 66 includes a cam surface 72 that engages a corresponding surface 74 of a second bearing assembly 76 (i.e., of the motor assembly 20). The wobble plate 66 also includes an annular wall 85 which is positioned off-center within the wobble plate 66 in order to engage the output shaft 70 in a camming action. Specifically, as the output shaft 70 rotates, the wobble plate 66 turns and, due to the cam surface 72 and the off-center position of the annular wall 84, the pistons 62 are individually engaged in turn. One having ordinary skill in the art will appreciate that other arrangements exist for driving the wobble plate 66 in order to actuate the pistons 62, each one of which falls within the spirit and scope of the present invention.

When the pistons 62 are actuated by the wobble plate 66, the pistons 62 preferably move within the chambers 38 in a reciprocating manner. As the pistons 62 move away from the inlet valves 50, fluid is drawn into the chambers 38 through the inlet apertures 88. As the pistons 62 move toward the inlet valves 50, fluid is pushed out of the chambers 38 through the outlet apertures 90 and through the outlet valves 52. Preferably, the pistons 62 are actuated sequentially. For example, the pistons 62 are preferably actuated so that fluid is drawn into the first chamber 40, then the second chamber 42, then the third chamber 44, then the fourth chamber 46, and finally into the fifth chamber 48.

FIGS. 10A–10E illustrate the structure of a diaphragm 54 according to a preferred embodiment of the present invention. The diaphragm 54 is preferably comprised of a single piece of resilient material with features integral with and molded into the diaphragm 54. Alternatively, the diaphragm 54 can be constructed of multiple elements connected together in any conventional manner, such as by fasteners, adhesive or cohesive bonding material, by snap-fit connections, and the like. The diaphragm 54 preferably includes a body portion 56 lying generally in a first plane 118. The diaphragm 54 has a front surface 58 which includes the pistons 62. Preferably, the pistons 62 lie generally in a second plane 120 parallel to the first plane 118 of the body portion 56.

In some preferred embodiments, each piston 62 includes an aperture 122 at its center through which a fastener (e.g., a screw 78 as shown in FIGS. 4 and 5) is received for connecting the fastener to the wobble plate 66. Preferably, the front surface 58 of the diaphragm 54 also includes raised ridges 124 extending around each of the pistons 62. The raised ridges 124 correspond to recesses (not shown) in the valve assembly 36 that extend around each one of the chambers 38. The raised ridges 124 and the recesses are positioned together to form a sealing relationship between the diaphragm 54 and the valve assembly 36 in order to define each one of the chambers 38. In other embodiments, the diaphragm 54 does not have raised ridges 124 as just described, but has a sealing relationship with the valve assembly 54 to isolate the chambers 38 in other manners. For example, the valve assembly 36 can have walls that extend to and are in flush relationship with the front surface 58 of the diaphragm 54. Alternatively, the chambers 38 can be isolated from one another by respective seals, one or more gaskets, and the like located between the valve assembly 36 and the diaphragm 54. Still other manners of isolating the chambers 38 from one another between the diaphragm 54 and the valve assembly 36 are possible, each one of which falls within the spirit and scope of the present invention.

The diaphragm 54 preferably includes a rear surface 126 which includes convolutes 128 corresponding to each one of the pistons 62. The convolutes 128 couple the pistons 62 to the body portion 56 of the diaphragm 54. The convolutes 128 function to allow the pistons 62 to move reciprocally without placing damaging stress upon the diaphragm 54. Specifically, the convolutes 128 preferably permit the pistons 62 to move with respect to the plane 118 of the body portion 56 without damage to the diaphragm 54. The convolutes 128 preferably lie generally in a third plane 130.

Preferably, each convolute 128 includes an inner perimeter portion 132 positioned closer to a center point 136 of the diaphragm 54 than an outer perimeter portion 134. The outer perimeter portion 134 of each convolute 128 can be comprised of more material than the inner perimeter portion 132. In other words, the depth of the convolute 128 at the outer perimeter portion 134 can be larger than the depth of the convolute 128 at the inner perimeter portion 132. This arrangement therefore preferably provides the piston 62 with greater range of motion at the outer perimeter than at the inner perimeter. In this connection, a bottom surface 138 of each convolute 128 can be oriented at an angle sloping away from the center point 136 of the diaphragm 54 and away from the second plane in which the pistons 62 lie. The inventors have discovered that reduced diaphragm stress results when this angle of the convolutes is between 2 and 4 degrees. More preferably, this angle is between 2.5 and 3.5 degrees. Most preferably, an angle of approximately 3.5 degrees is employed to reduce stress in the diaphragm 54. By reducing diaphragm stress in this manner, the life of the diaphragm 54 is significantly increased, thereby improving pump reliability.

In some preferred embodiments of the present invention, the pistons 62 have rearwardly extending extensions 140 for connection of the diaphragm 54 to the wobble plate 66. The extensions 140 can be separate elements connected to the diaphragm 54 in any conventional manner, but are more preferably integral with the bottom surfaces 138 of the convolutes 128. With reference to the illustrated preferred embodiment, the screws 78 are preferably received in the apertures 122, through the cylindrical extensions 140, and into the extensions 80 of the rocker arms 64 as best shown in FIGS. 4 and 5. If desired, bushings 82 can also be coupled around the cylindrical extensions 140 between the convolutes 128 and the extensions 80 of the rocker arm 64.

Figure 12B:
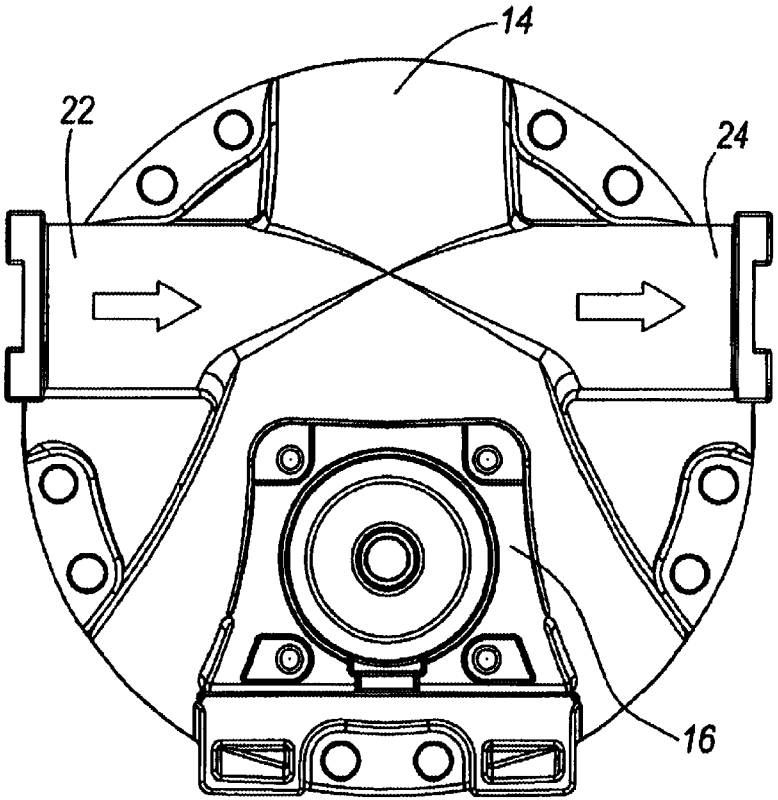
FIG. 12B is an exterior view of the pump front housing illustrated in FIG. 12A.
Figure 12A:
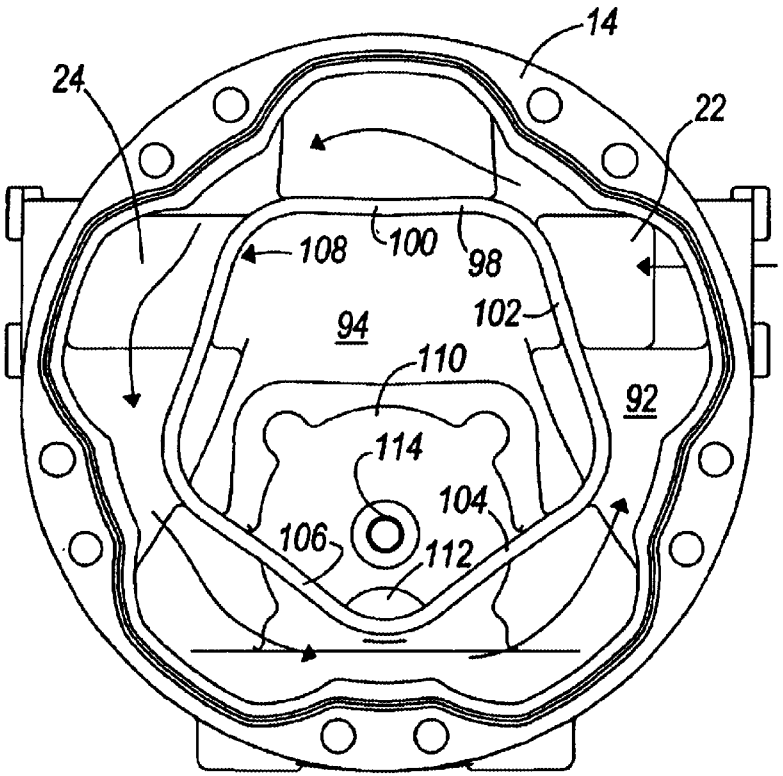
FIG. 12A is an interior view of a pump front housing according to a preferred embodiment of the present invention.

With reference next to FIG. 12A, the interior of the front housing 14 preferably includes an inlet chamber 92 and an outlet chamber 94. The inlet chamber 92 is in communication with the inlet port 22 and the outlet chamber 94 is in communication with the outlet port 24. Preferably, the inlet chamber 92 is separated from the outlet chamber 94 by a seal 96 (as shown in FIG. 6). The seal 96 can be retained within the pump 10 in any conventional manner, such as by being received within a recess in the valve assembly 36 or pump housing, by adhesive or cohesive bonding material, by one or more fasteners, and the like.

When the valve assembly 36 of the illustrated preferred embodiment is positioned within the front housing 14, the seal 96 engages wall 98 formed within the front housing 14 in order to prevent fluid from communicating between the inlet chamber 92 and the outlet chamber 94. Thus, the inlet port 22 is in communication with the inlet chamber 92, which is in communication with each of the chambers 38 via the inlet apertures 88 and the inlet valves 50. The chambers 38 are also in communication with the outlet chamber 94 via the outlet apertures 90 and the outlet valves 52.

Figure 11B:
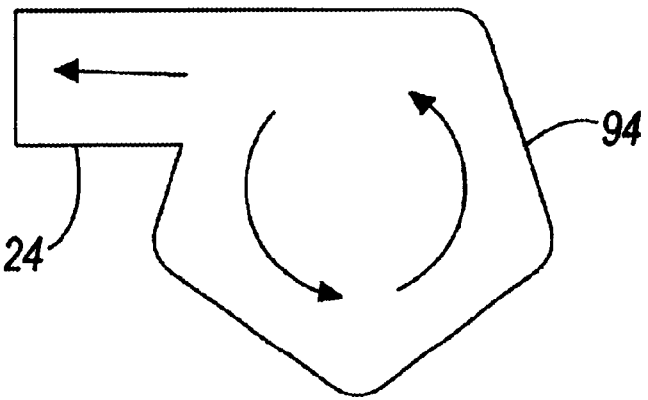
FIG. 11B is a schematic illustration of an outlet chamber and an outlet port of a pump according to a preferred embodiment of the present invention.
Figure 11A:
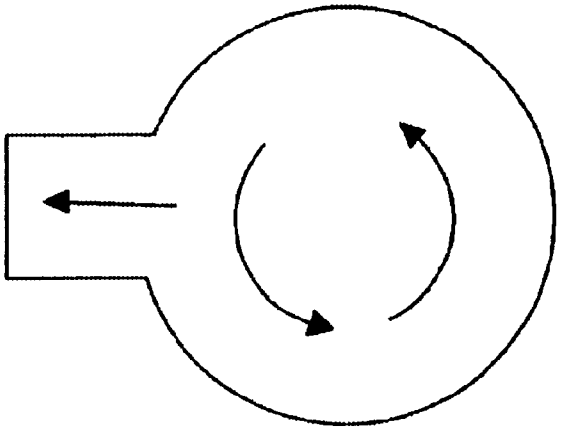
FIG. 11A PRIOR ART
FIG. 11A is a schematic illustration of an outlet chamber and an outlet port of a prior art pump.

As shown schematically in FIG. 11A, the outlet ports in pumps of the prior art are often positioned non-tangentially with respect to the circumference of an outlet chamber. In these pumps, as the pistons sequentially push the fluid into the outlet chamber, the fluid flows along a circular path in a counter-clockwise rotation within the outlet chamber. However, in order to exit through the outlet port, the fluid must diverge from the circular path at a relatively sharp angle. Conversely, as shown schematically in FIG. 11B, the outlet port 24 of the pump 10 in some embodiments of the present invention is positioned tangentially to the outlet chamber 94. Specifically, as shown in FIG. 12A, the outlet port 24 is positioned tangentially with respect to the wall 98 and the outlet chamber 94. In the pump 10, the fluid also flows in a circular path and in a counter-clockwise rotation within the outlet chamber 94, but the fluid is not forced to diverge from the circular path to exit through the outlet port 24 at a sharp angle. Rather, the fluid continues along the circular path and transitions into the outlet port 24 by exiting tangentially from flow within the outlet chamber 94. Having the outlet port 24 tangential to the outlet chamber 94 can also help to evacuate air from the pump 10 at start-up. Having the outlet port 24 tangential to the outlet chamber 94 can also improve the efficiency of the pump 10 during low pressure/high flow rate conditions.

Although the wall 98 defining the outlet chamber 94 is illustrated as being pentagon-shaped, the wall 98 can be any suitable shape for the configuration of the chambers 38 (e.g., three-sided for pumps having three chambers, four-sided for pumps having four chambers 38, and the like), and preferably is shaped so that the outlet port 24 is positioned tangentially with respect to the outlet chamber 94.

With continued reference to the illustrated preferred embodiment of the pump 10, the inlet port 22 and the outlet port 24 are preferably positioned parallel to a first side 100 of the pentagon-shaped wall 98. The pentagon-shaped wall 98 includes a second side 102, a third side 104, a fourth side 106, and a fifth side 108. As shown in FIG. 12A, the front housing 14 includes a raised portion 110 positioned adjacent an angle 112 between the third side 104 and the fourth side 106 of the pentagon-shaped wall 98. The raised portion 110 includes an aperture 114 within which a pressure sensor 116 is positioned. Thus, the pressure sensor 116 is in communication with the outlet chamber 94. Preferably, the pressure sensor 116 is a silicon semiconductor pressure sensor. In some preferred embodiments, the pressure sensor 116 is a silicon semiconductor pressure sensor manufactured by Honeywell (e.g., model 22PCFEM1A). The pressure sensor 116 is comprised of four resistors or gages in a bridge configuration in order to measure changes in resistance corresponding to changes in pressure within the outlet chamber 94.

Figure 13:
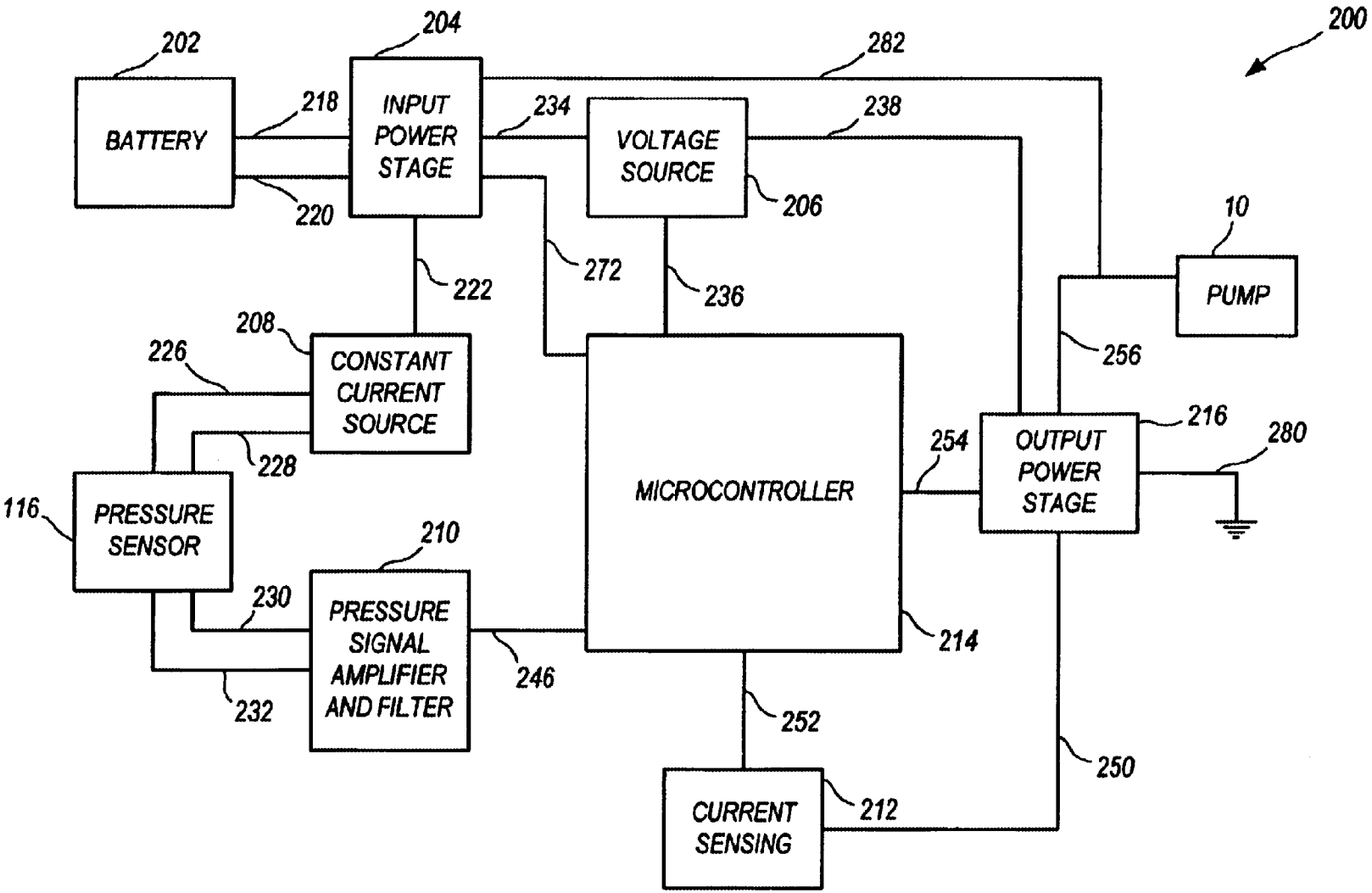
FIG. 13 is a schematic illustration of a pump control system according to a preferred embodiment of the present invention.

FIG. 13 is a schematic illustration of an embodiment of a pump control system 200 according to the present invention. As shown in FIG. 13, the pressure sensor 116 is included in the pump control system 200. The pump control system 200 includes a battery 202 or an AC power line (not shown) coupled to an analog-to-digital converter (not shown), an input power stage 204, a voltage source 206, a constant current source 208, a pressure signal amplifier and filter 210, a current sensing circuit 212, a microcontroller 214, and an output power stage 216 coupled to the pump 10. Preferably, components of the pump control system 200 are made with integrated circuits mounted on a circuit board (not shown) that is positioned within the motor assembly 20.

The battery 202 is most preferably a standard automotive battery having a fully-charged voltage level of 13.6 Volts. However, the voltage level of the battery 202 will vary during the life of the battery 202. Accordingly, the pump control system 200 preferably provides power to the pump as long as the voltage level of the battery 202 is between a low threshold and a high threshold. In the illustrated preferred embodiment, the low threshold is approximately 8 Volts to accommodate for voltage drops between a battery harness (e.g., represented by connections 218 and 220) and the pump 10. For example, a significant voltage drop may occur between a battery harness coupled to an automotive battery adjacent a recreational vehicle's engine and a pump 10 mounted in the rear of the recreational vehicle. Also in the illustrated preferred embodiment, the high threshold is preferably approximately 14 Volts to accommodate for a fully-charged battery 202, but to prevent the pump control system 200 from being subjected to voltage spikes, such as when an automotive battery is being charged by another automotive battery.

Figure 14:
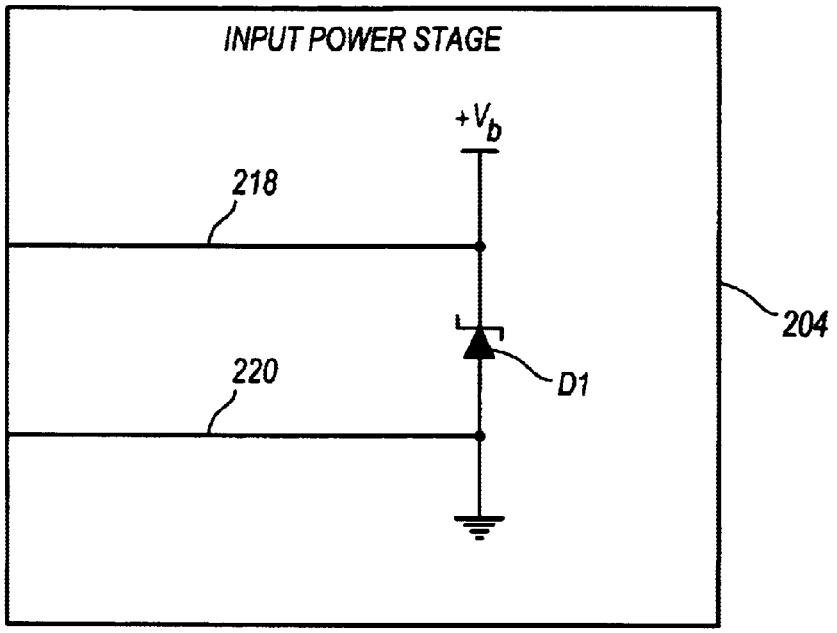
FIG. 14 is a schematic illustration of the input power stage illustrated in FIG. 13.

The battery 202 is connected to the input power stage 204 via the connections 218 and 220. As shown in FIG. 14, the connection 218 is coupled to the positive terminal of the battery 202 in order to provide a voltage of $+V_b$ to the pump control system 200. The connection 220 is coupled to the negative terminal of the battery 202, which behaves as an electrical ground. A zener diode D1 is coupled between the connections 218 and 220 in order to suppress any transient voltages, such as noise from an alternator that is also coupled to the battery 202. In some preferred embodiments, the zener diode D1 is a generic model 1.5KE30CA zener diode available from several manufacturers.

Figure 15:
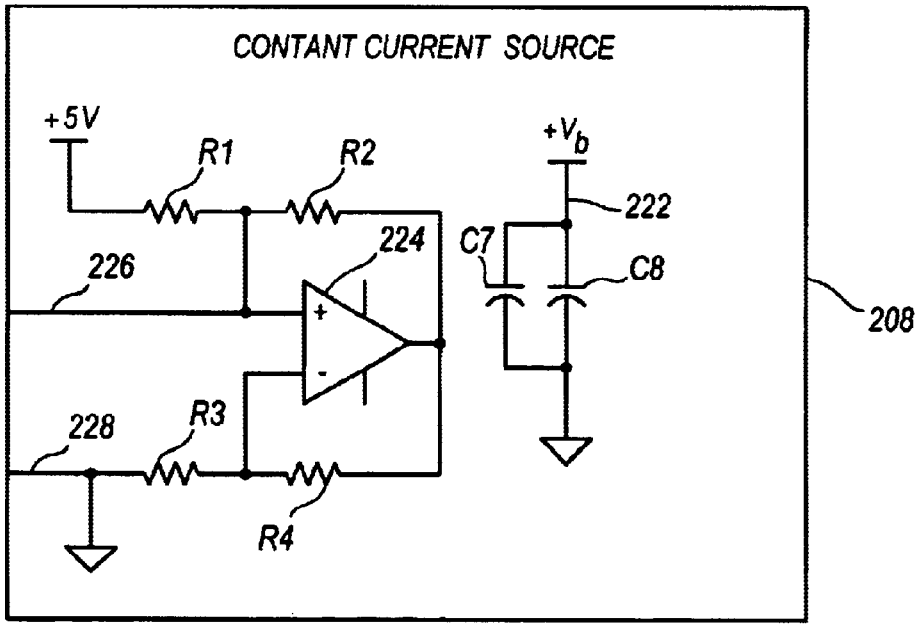
FIG. 15 is a schematic illustration of the constant current source illustrated in FIG. 13.

The input power stage 204 is coupled to a constant current source 208 via a connection 222, and the constant current source 208 is coupled to the pressure sensor 116 via a connection 226 and a connection 228. As shown in FIG. 15, the constant current source 208 includes a pair of decoupling and filtering capacitors C7 and C8, which prevent electromagnetic emissions from other components of the pump control circuit 200 from interfering with the constant current source 208. In some preferred embodiments, the capacitance of C7 is 100 nF and the capacitance of C8 is 100 pF.

The constant current source 208 includes an operational amplifier 224 coupled to a resistor bridge, including resistors R1, R2, R3, and R4. The operational amplifier 224 is preferably one of four operational amplifiers within a model LM324/SO integrated circuit manufactured by National Semiconductor, among others. The resistor bridge is designed to provide a constant current and so that the output of the pressure sensor 116 is a voltage differential value that is reasonable for use in the pump control system 200. The resistances of resistors R1, R2, R3, and R4 are preferably equal to one another, and are most preferably 5 kΩ. By way of example only, for a 5 kΩ resistor bridge, if the constant current source 208 provides a current of 1 mA to the pressure sensor 116, the voltages at the inputs 230 and 232 to the pressure signal amplifier and filter circuit 210 are between approximately 2V and 3V. In addition, the absolute value of the voltage differential between the inputs 230 and 232 will range from approximately 0 mV to 100 mV. Most preferably, the absolute value of the voltage differential between the inputs 230 and 232 is designed to be approximately 50 mV. The voltage differential between the inputs 230 and 232 is a signal that represents the pressure changes in the outlet chamber 94.

Figure 17:
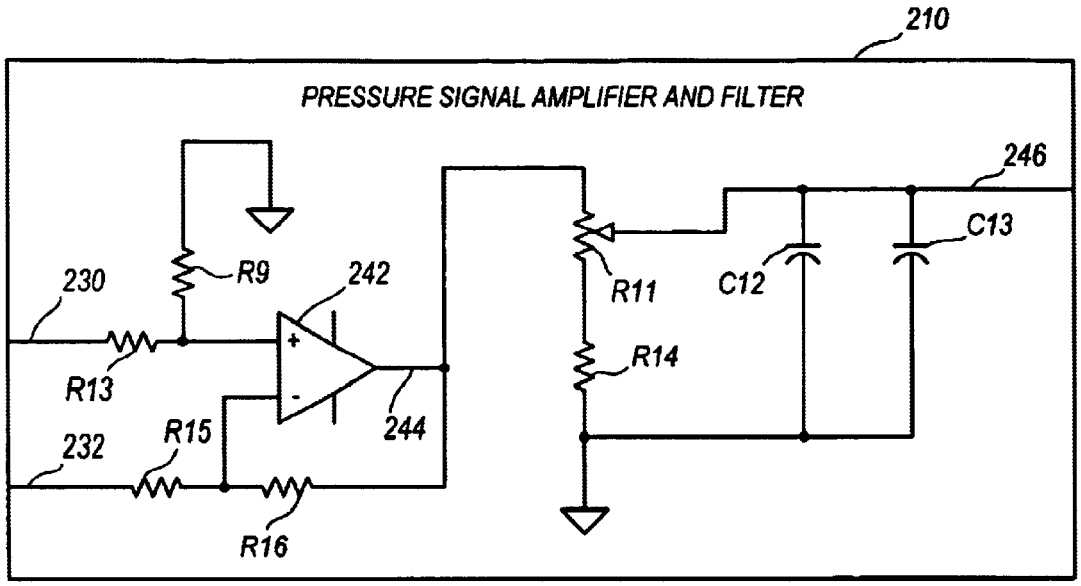
FIG. 17 is a schematic illustration of the pressure signal amplifier and filter illustrated in FIG. 13.

As shown in FIG. 17, the pressure signal amplifier and filter circuit 210 includes an operational amplifier 242 and a resistor network including R9, R13, R15, and R16. In some preferred embodiments, the operational amplifier 242 is a second of the four operational amplifiers within the LM324/SO integrated circuit. The resistor network is preferably designed to provide a gain of 100 for the voltage differential signal from the pressure sensor 116 (e.g., the resistance values are 1 kΩ for R13 and R15 and 100 kΩ for R9 and R16). The output 244 of the operational amplifier 242 is coupled to a potentiometer R11 and a resistor R14. The potentiometer R11 for each individual pump 10 is adjusted during the manufacturing process in order to calibrate the pressure sensor 116 of each individual pump 10. In some preferred embodiments, the maximum resistance of the potentiometer R11 is 5 kΩ, the resistance of the resistor R14 is 1 kΩ, and the potentiometer R11 is adjusted so that the shut-off pressure for each pump 10 is 65 PSI at 12V. The potentiometer R11 is coupled to a pair of noise-filtering capacitors C12 and C13, preferably having capacitance values of 100 nF and 100 pF, respectively. An output 246 of the pressure signal amplifier and filter circuit 210 is coupled to the microcontroller 214, providing a signal representative of the pressure within the outlet chamber 94 of the pump 10.

Figure 16:
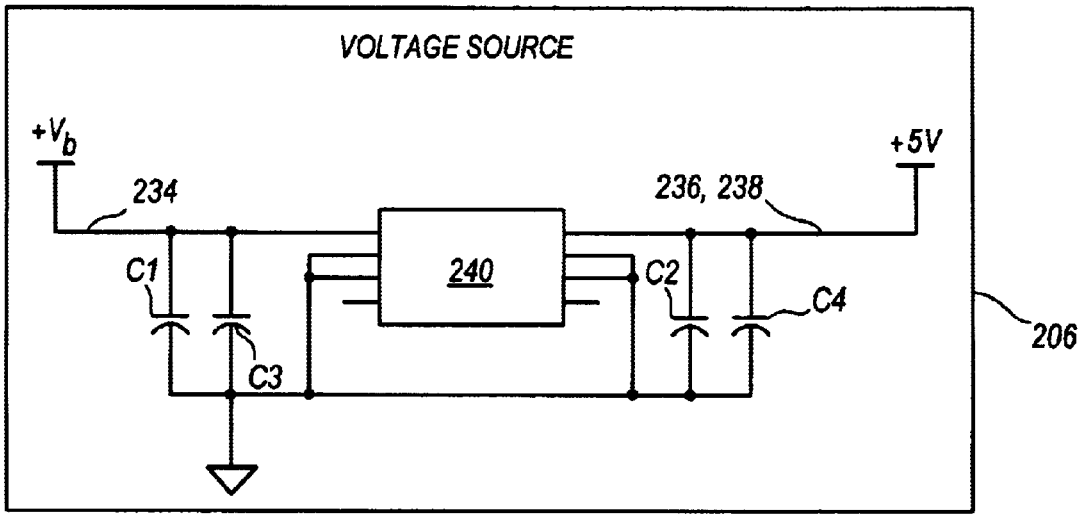
FIG. 16 is a schematic illustration of the voltage source illustrated in FIG. 13.

The input power stage 204 is also connected to the voltage source 206 via a connection 234. As shown in FIG. 16, the voltage source 206 converts the voltage from the battery (i.e., $+V_b$) to a suitable voltage (e.g., +5V) for use by the microcontroller 214 via a connection 236 and the output power stage 216 via a connection 238. The voltage source 206 includes an integrated circuit 240 (e.g., model LM78L05ACM manufactured by National Semiconductor, among others) for converting the battery voltage to +5V. The integrated circuit 240 is coupled to capacitors C1, C2, C3, and C4. The capacitance of the capacitors is designed to provide a constant, suitable voltage output for use with the microcontroller 214 and the output power stage 216. In some preferred embodiments, the capacitance values are 680 uF for C1, 10 uF for C2, 100 nF for C3, and 100 nf for C4. In addition, the maximum working-voltage rating of the capacitors C1–C4 is $35V_{dc}$.

Figure 18:
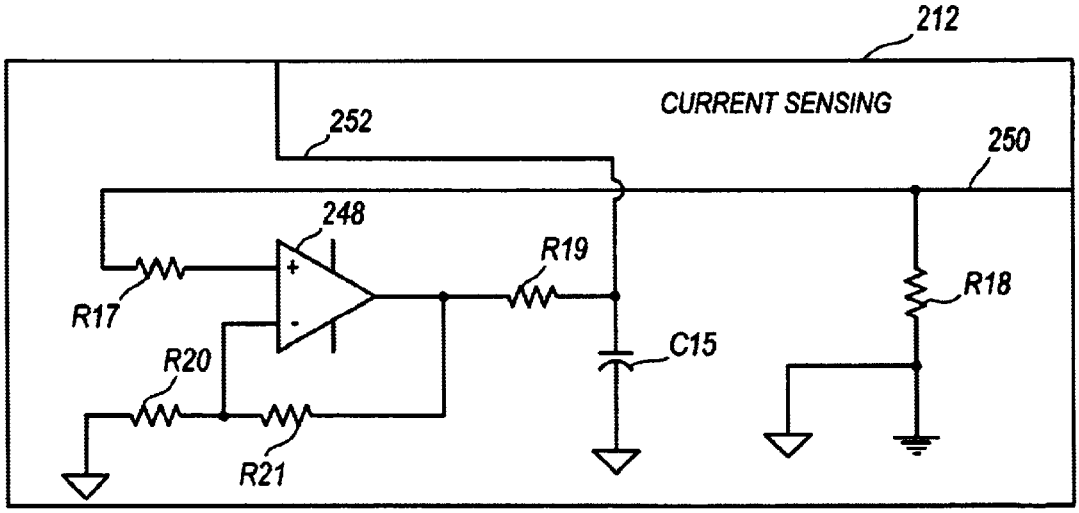
FIG. 18 is a schematic illustration of the current sensing circuit illustrated in FIG. 13.

As shown in FIG. 18, the current sensing circuit 212 is coupled to the output power stage 216 via a connection 250 and to the microcontroller 214 via a connection 252. The current sensing circuit 212 provides the microcontroller 214 a signal representative of the level of current being provided to the pump 10. The current sensing circuit 212 includes a resistor R18, which preferably has a low resistance value (e.g., 0.01Ω) in order to reduce the value of the current signal being provided to the microcontroller 214. The resistor R18 is coupled to an operational amplifier 248 and a resistor network, including resistors R17, R19, R20, and R21 (e.g., having resistance values of 1 kΩ for R17, R19, and R20 and 20 kΩ for R21). The output of the amplifier 248 is also coupled to a filtering capacitor C15, preferably having a capacitance of 10 uF and a maximum working-voltage rating of $35V_{dc}$. In some preferred embodiments, the operational amplifier 248 is the third of the four operational amplifiers within the LM324/SO integrated circuit. Preferably, the signal representing the current is divided by approximately 100 by the resistor R18 and is then amplified by approximately 20 by the operational amplifier 248, as biased by the resistors R17, R19, R20, and R21, so that the signal representing the current provided to the microcontroller 214 has a voltage amplitude of approximately 2V.

Figure 19:
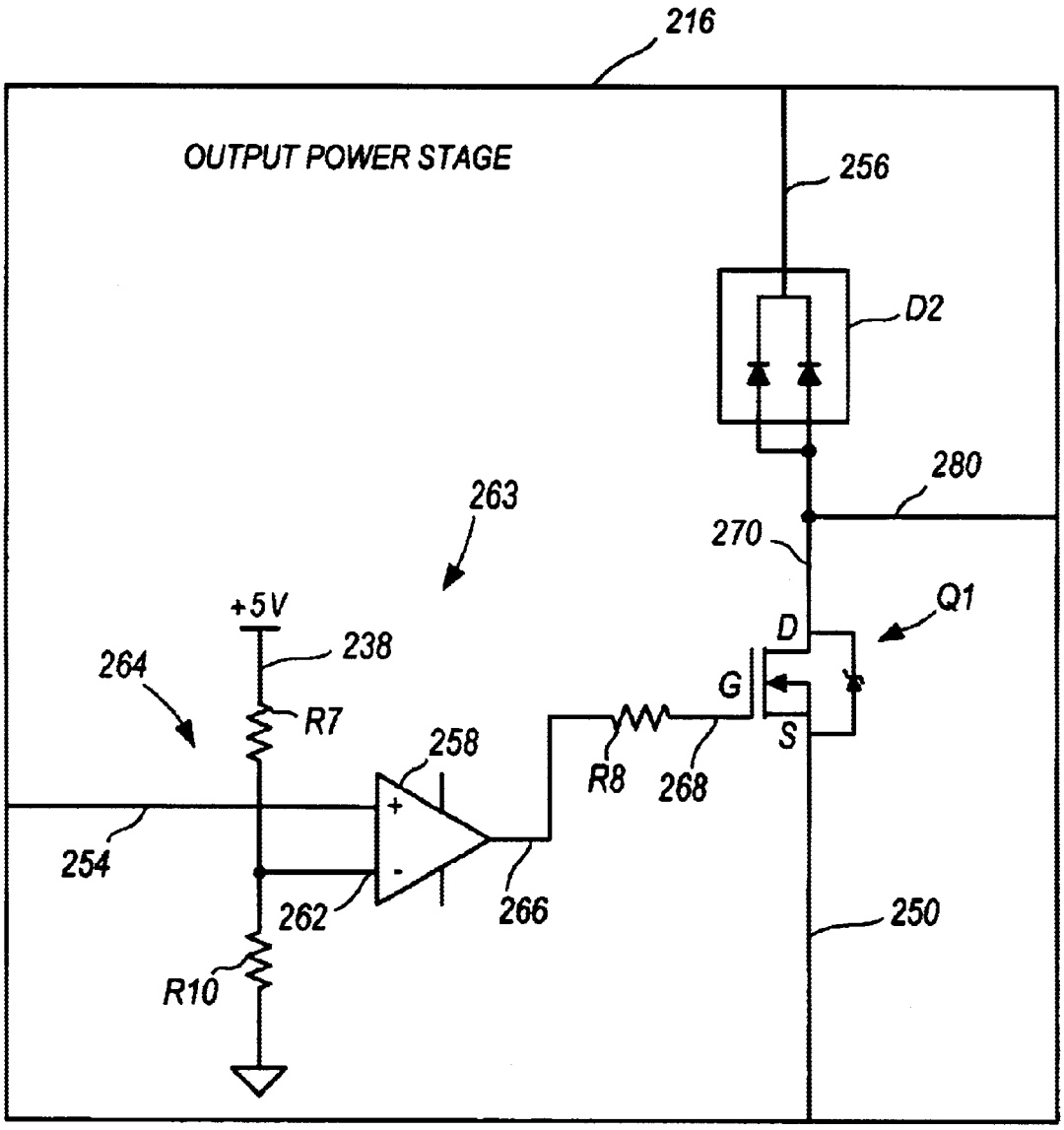
FIG. 19 is a schematic illustration of the output power stage illustrated in FIG. 13.

As shown in FIG. 19, the output power stage 216 is coupled to the voltage source 206 via the connection 238, to the current sensing circuit 212 via the connection 250, to the microcontroller 214 via a connection 254, and to the pump via a connection 256. The output power stage 216 receives a control signal from the microcontroller 214. As will be described in greater detail below, the control signal preferably cycles between 0V and 5V.

The output power stage 216 includes a comparator circuit 263. The comparator circuit 263 includes an operational amplifier 258 coupled to the microcontroller 214 via the connection 254 in order to receive the control signal. A first input 260 to the operational amplifier 258 is coupled directly to the microcontroller 214 via the connection 254. A second input 262 to the operational amplifier 258 is coupled to the voltage source 206 via a voltage divider circuit 264, including resistors R7 and R10. In some preferred embodiments, the voltage divider circuit 264 is designed so that the +5V from the voltage source 206 is divided by half to provide approximately +2.5V at the second input 262 of the operational amplifier 258 (e.g., the resistances of R7 and R10 are 5 kΩ). The comparator circuit 263 is used to compare the control signal, which is either 0V or 5V, at the first input 260 of the operational amplifier 258 to the +2.5V at the second input 262 of the operational amplifier 258. If the control signal is 0V, an output 266 of the operational amplifier 258 is positive. If the control signal is 5V, the output 266 of the operational amplifier 258 is close to zero.

The output 266 of the operational amplifier 258 is coupled to a resistor R8, the signal output by resistor R8 acts as a driver for a gate 268 of a transistor Q1. In some preferred embodiments, the transistor Q1 is a single-gate, n-channel, metal-oxide semiconductor field-effect transistor (MOSFET) capable of operating at a frequency of 1 kHz (e.g., model IRLI3705N manufactured by International Rectifier or NDP7050L manufactured by Fairchild Semiconductors). The transistor Q1 acts like a switch in order to selectively provide power to the motor assembly 20 of the pump 10 when an appropriate signal is provided to the gate 268. Specifically, if the voltage provided to the gate 268 of the transistor Q1 is positive, the transistor Q1 is "on" and provides power to the pump 10 via a connection 270. Conversely, if the voltage provided to the gate 268 of the transistor Q1 is negative, the transistor Q1 is "off" and does not provide power to the pump 10 via the connection 270.

The drain of the transistor Q1 is connected to a free-wheeling diode circuit D2 via the connection 270. The diode circuit D2 releases the inductive energy created by the motor of the pump 10 in order to prevent the inductive energy from damaging the transistor Q1. In some embodiments, the diodes in the diode circuit D2 are model MBRB3045 manufactured by International Rectifier or model SBG3040 manufactured by Diodes, Inc. The diode circuit D2 is connected to the pump 10 via the connection 256.

The drain of the transistor Q1 is also connected to a ground via a connection 280. The input power stage 204 is coupled between the diode circuit D2 and the pump 10 via a connection 282. By way of example only, if the control signal is 5V, the transistor Q1 is "on" and approximately $+V_b$ is provided to the pump 10 from the input power stage 204. However, if the control signal is 0V, the transistor Q1 is "off" and $+V_b$ is not provided to the pump 10 from the input power stage 204.

Figure 20:
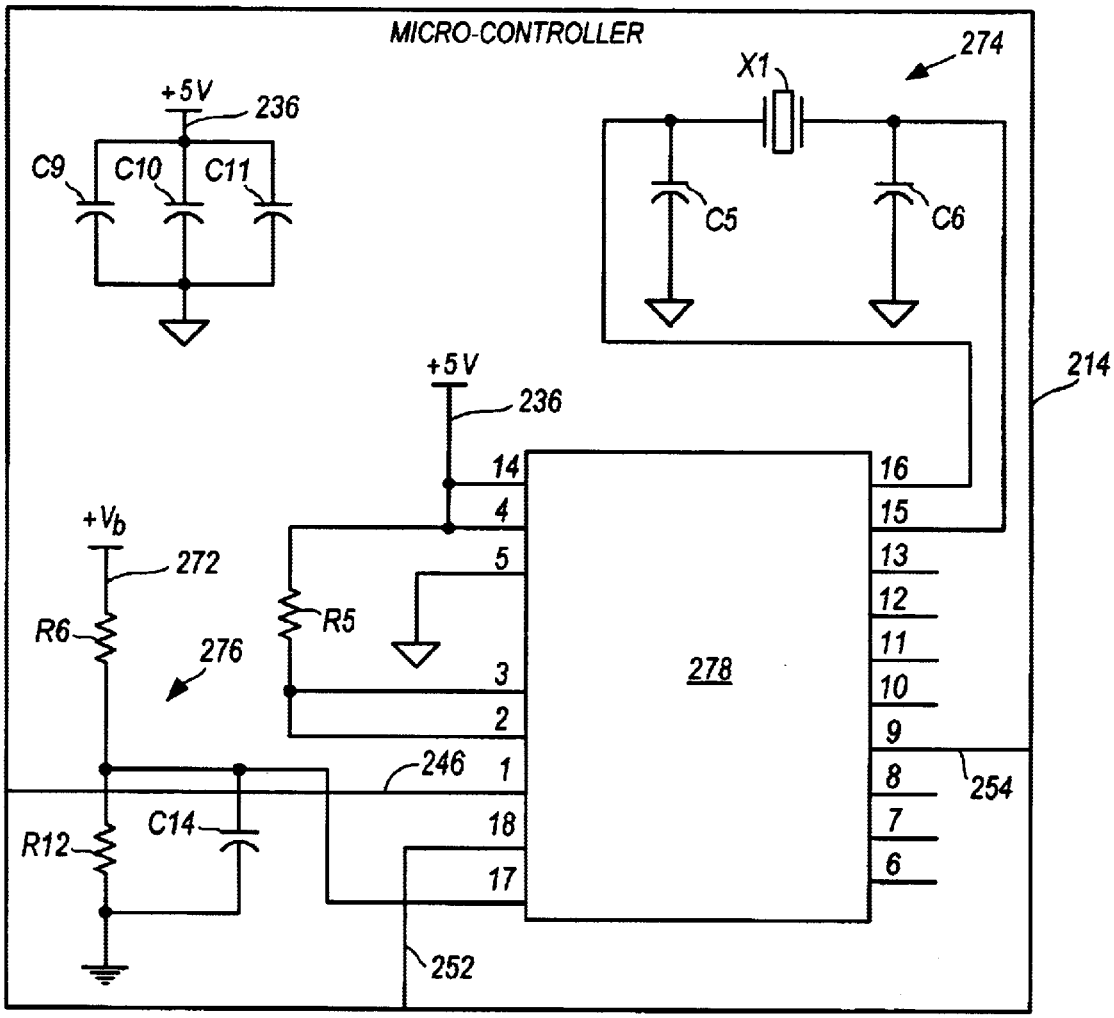
FIG. 20 is a schematic illustration of the microcontroller illustrated in FIG. 13.

As shown in FIG. 20, the microcontroller 214 includes a microprocessor integrated circuit 278, which is programmed to perform various functions, as will be described in detail below. In some preferred embodiments, the microprocessor 278 is a model PIC16C711 manufactured by Microchip Technology, Inc. The microcontroller 214 includes decoupling and filtering capacitors C9, C10, and C11 (e.g., in some embodiments having capacitance values of 100 nF, 10 nF, and 100 pF, respectively), which connect the voltage source 206 to the microprocessor 278 (at pin 14). The microcontroller 214 includes a clocking signal generator 274 comprised of a crystal or oscillator X1 and loading capacitors C5 and C6. In some preferred embodiments, the crystal X1 operates at 20 MHz and the loading capacitors C5 and C6 each have a capacitance value of 22 pF. The clocking signal generator 274 provides a clock signal input to the microprocessor 278 and is coupled to pin 15 and to pin 16.

The microprocessor 278 is coupled to the input power stage 204 via the connection 272 in order to sense the voltage level of the battery 202. Preferably, a voltage divider circuit 276, including resistors R6 and R12 and a capacitor C14, is connected between the input power stage 204 and of the microprocessor 278 (at pin 17). The capacitor C14 filters out noise from the voltage level signal from the battery 202. In some preferred embodiments, the resistances of the resistors R6 and R12 are 5 kΩ and 1 kΩ, respectfully, the capacitance of the capacitor C14 is 100 nF, and the voltage divider circuit 276 reduces the voltage from the battery 202 by one-sixth.

The microprocessor 278 (at pin 1) is connected to the pressure signal amplifier and filter 210 via the connection 246. The microprocessor 278 (at pin 18) is connected to the current sensing circuit 212 via the connection 252. The pins 1, 17, and 18 are coupled to internal analog-to-digital converters. Accordingly, the voltage signals representing the pressure in the outlet chamber 94 (at pin 1), the voltage level of the battery 202 (at pin 17), and the current being supplied to the motor assembly 20 via the transistor Q1 (at pin 18) are each converted into digital signals for use by the microprocessor 278. Based on the voltage signals at pins 1, 17, and 18, the microprocessor 278 provides a control signal (at pin 9) to the output power stage 216 via the connection 254.

Figure 21A:
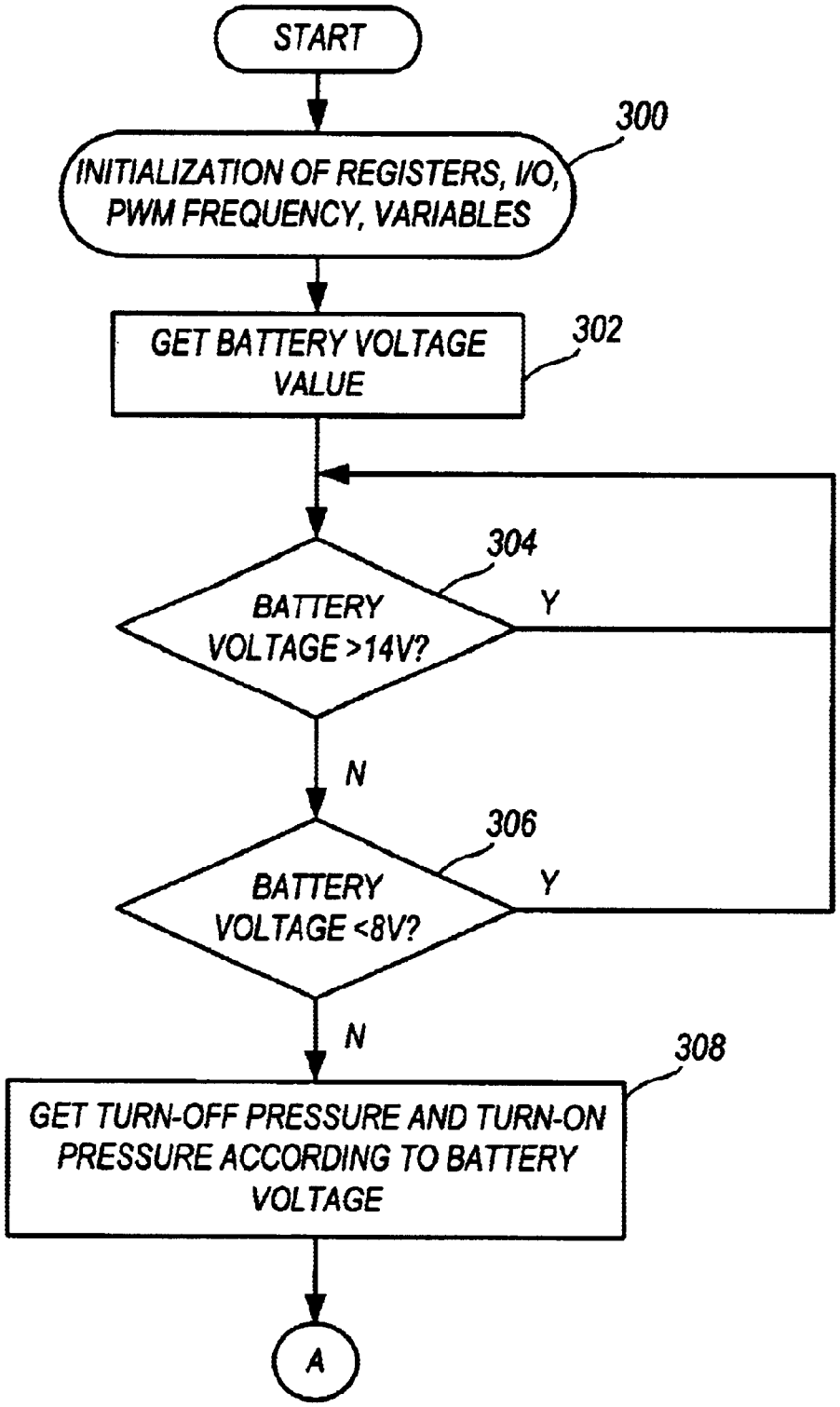
FIGS. 21A–21F are flow charts illustrating the operation of the pump control system of FIG. 13.

Referring to FIGS. 21A–21F, the microprocessor 278 is programmed to operate the pump control system 200 as follows. Referring first to FIG. 21A, the microprocessor 278 is initialized (at 300) by setting various registers, inputs/outputs, and variables. Also, an initial pulse-width modulation frequency is set in one embodiment at 1 kHz. The microprocessor 278 reads (at 302) the voltage signal representing the voltage level of the battery 202 (at pin 17). The microprocessor 278 determines (at 304 and 306) whether the voltage level of the battery 202 is greater than a low threshold (e.g., 8V) but less than a high threshold (e.g., 14V). If the voltage level of the battery 202 is not greater than the low threshold and less than the high threshold, the microprocessor 278 attempts to read the voltage level of the battery 202 again. The microprocessor 287 does not allow the pump control system 200 to operate until the voltage level of the battery 202 is greater than the low threshold but less than the high threshold.

Once the sensed voltage level of the battery 202 is greater than the low threshold but less than the high threshold, the microprocessor 278 obtains (at 308) a turn-off or shut-off pressure value and a turn-on pressure value, each of which correspond to the sensed voltage level of the battery 202, from a look-up table stored in memory (not shown) accessible by the microprocessor 278. The turn-off pressure value represents the pressure at which the pump 10 will stall if the pump 10 is not turned off or if the pump speed is not reduced. The pump 10 will stall when the pressure within the pump 10 becomes too great for the rotor of the motor within the motor assembly 20 to turn given the power available from the battery 202. Rather than just allowing the pump 10 to stall, the pump 10 is turned off or the speed of the pump 10 is reduced so that the current being provided to the pump 10 does not reach a level at which the heat generated will damage the components of the pump 10. The turn-on pressure value represents the pressure at which the fluid in the pump 10 must reach before the pump 10 is turned on.

Figure 21B:
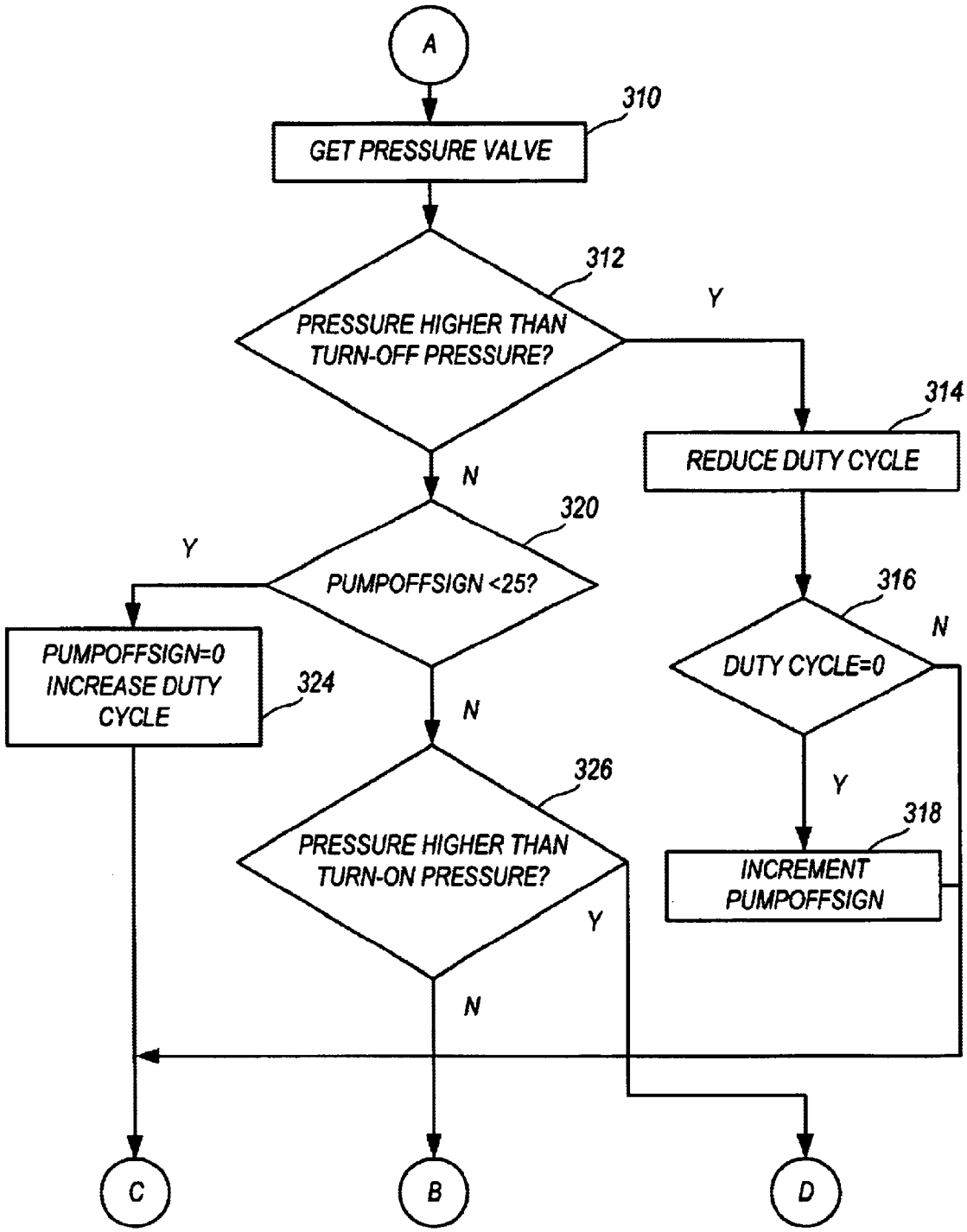

Referring to FIG. 21B, the microprocessor 278 reads (at 310) the voltage signal (at pin 1) representing the pressure within the outlet chamber 94 as sensed by the pressure sensor 116. The microprocessor 278 determines (at 312) whether the sensed pressure is greater than the turn-off pressure value. If the sensed pressure is greater than the turn-off pressure value, the microprocessor 278 reduces the speed of the pump 10. Preferably, the microprocessor 278 reduces the speed of the pump 10 by reducing (at 314) the duty cycle of a pulse-width modulation (PWM) control signal being transmitted to the output power stage 216 via the connection 254. The duty cycle of a PWM control signal is generally defined as the percentage of the time that the control signal is high (e.g., +5V) during the period of the PWM control signal.

The microprocessor 278 also determines (at 316) whether the duty cycle of the PWM control signal has already been reduced to zero, so that the pump 10 is already being turned off. If the duty cycle is already zero, the microprocessor 278 increments (at 318) a "Pump Off Sign" register in the memory accessible to the microprocessor 278 in order to track the time period for which the duty cycle has been reduced to zero. If the duty cycle is not already zero, the microprocessor 278 proceeds to a current limiting sequence, as will be described below with respect to FIG. 21D.

If the microprocessor 278 determines (at 312) that the sensed pressure is not greater than the turn-off pressure value, the microprocessor then determines (at 320) whether the "Pump Off Sign" register has been incremented more than 25 times. In other words, the microprocessor 278 determines (at 320) whether the pump has already been completely shut-off. If the microprocessor 278 determines (at 320) that the "Pump Off Sign" has not been incremented more than 25 times, the microprocessor 278 clears (at 324) the "Pump Off Sign" register and increases (at 324) the duty cycle of the PWM control signal. If the "Pump Off Sign" has not been incremented more than 25 times, the pump 10 has not been completely turned-off, fluid flow through the pump has not completely stopped, and the pressure of the fluid within the pump 10 is relatively low. The microprocessor 278 continues to the current limiting sequence described below with respect to FIG. 21D.

However, if the microprocessor 278 determines (at 320) that the "Pump Off Sign" has been incremented more than 25 times, the pump 10 has been completely turned-off, fluid flow through the pump has stopped, and the pressure of the fluid in the pump 10 is relatively high. The microprocessor 278 then determines (at 322) whether the sensed pressure is greater then the turn-on pressure value. If the sensed pressure is greater than the turn-on pressure value, the microprocessor 278 proceeds directly to a PWM sequence, which will be described below with respect to FIG. 21E. If the sensed pressure is less than the turn-on pressure value, the microprocessor 278 proceeds to a pump starting sequence, as will be described with respect to FIG. 21C.

Figure 21C:
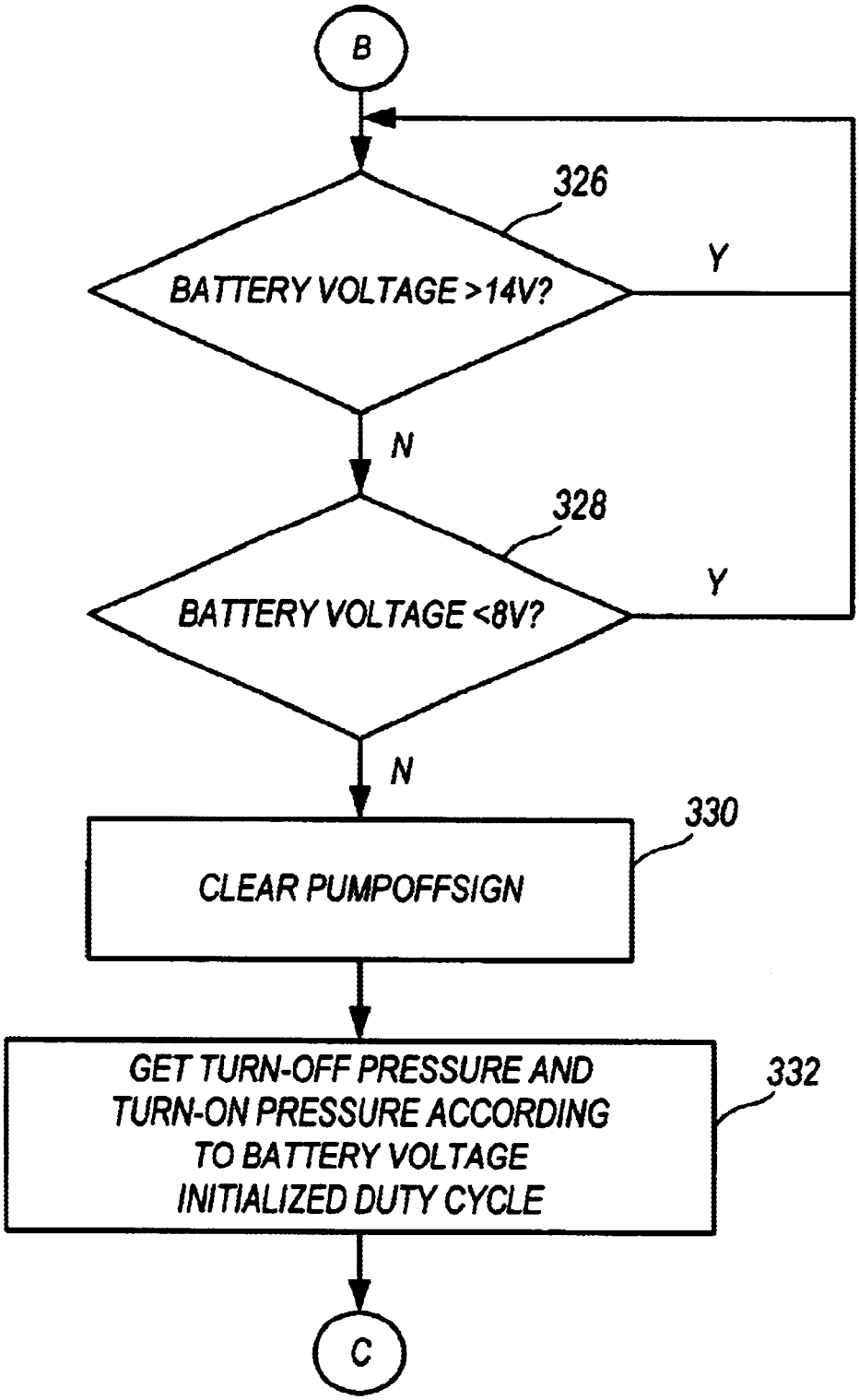

Referring to FIG. 21C, before starting the pump 10, the microprocessor 278 verifies (at 326 and 328) that the voltage of the battery 202 is still between the low threshold and the high threshold. If the voltage of the battery 202 is between the low threshold and the high threshold, the microprocessor 278 clears (at 330) the "Pump Off Sign" register. Preferably, the microprocessor 278 then obtains (at 332) the turn-off pressure value and the turn-on pressure value from the look-up table for the current voltage level reading for the battery 202.

Figure 21D:
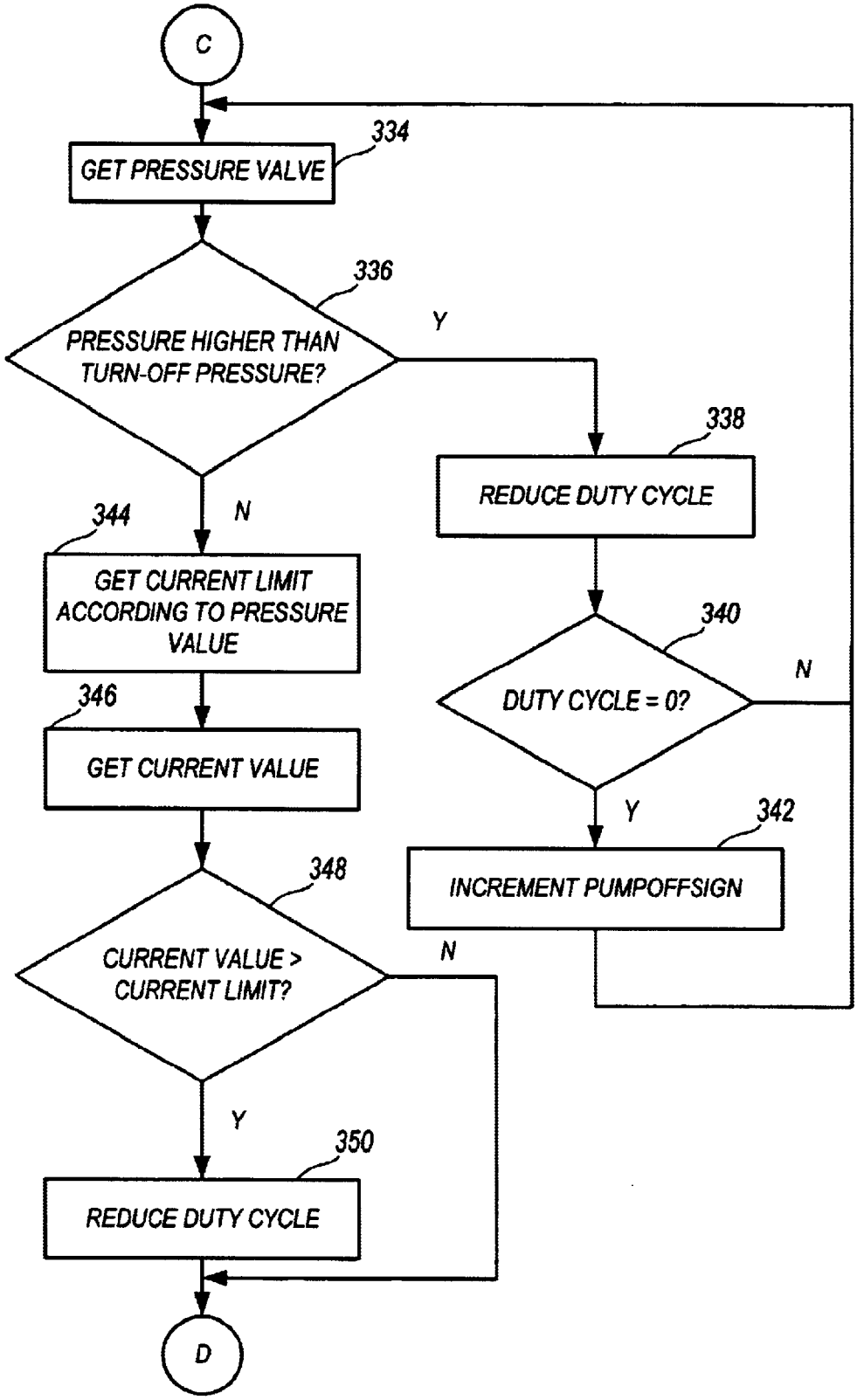

The microprocessor 278 then proceeds to the current limiting sequence as shown in FIG. 21D. The microprocessor 278 again reads (at 334) the voltage signal (at pin 1) representing the pressure within the outlet chamber 94 as sensed by the pressure sensor 116. The microprocessor 278 again determines (at 336) whether the sensed pressure is greater than the turn-off pressure value.

If the sensed pressure is greater than the turn-off pressure value, the microprocessor 278 reduces the speed of the pump 10 by reducing (at 338) the duty cycle of the PWM control signal being transmitted to the output power stage 216 via the connection 254. The microprocessor 278 also determines (at 340) whether the duty cycle of the PWM control signal has already been reduced to zero, so that the pump 10 is already being turned off. If the duty cycle is already zero, the microprocessor 278 increments (at 342) the "Pump Off Sign" register. If the duty cycle is not already zero, the microprocessor 278 returns to the beginning of the current limiting sequence (at 334).

If the sensed pressure is less than the turn-off pressure value, the pump 10 is generally operating at an acceptable pressure, but the microprocessor 278 must determine whether the current being provided to the pump 10 is acceptable. Accordingly, the microprocessor 278 obtains (at 344) a current limit value or threshold from a look-up table stored in memory accessible by the microprocessor 278. The current limit value corresponds to the maximum current that will be delivered to the pump 10 for each particular sensed pressure. The microprocessor 278 also reads (at 346) the voltage signal (at pin 18) representing the current being provided to the pump 10 (i.e., the signal from the current sensing circuit 212 transmitted by connection 252). The microprocessor 278 determines (at 348) whether the sensed current is greater than the current limit value. If the sensed current is greater than the current limit value, the microprocessor 278 reduces the speed of the pump 10 so that the pump 10 does not stall by reducing (at 350) the duty cycle of the PWM control signal until the sensed current is less than the current limit value. The microprocessor 278 then proceeds to the PWM sequence, as shown in FIG. 21E.

Figure 21E:
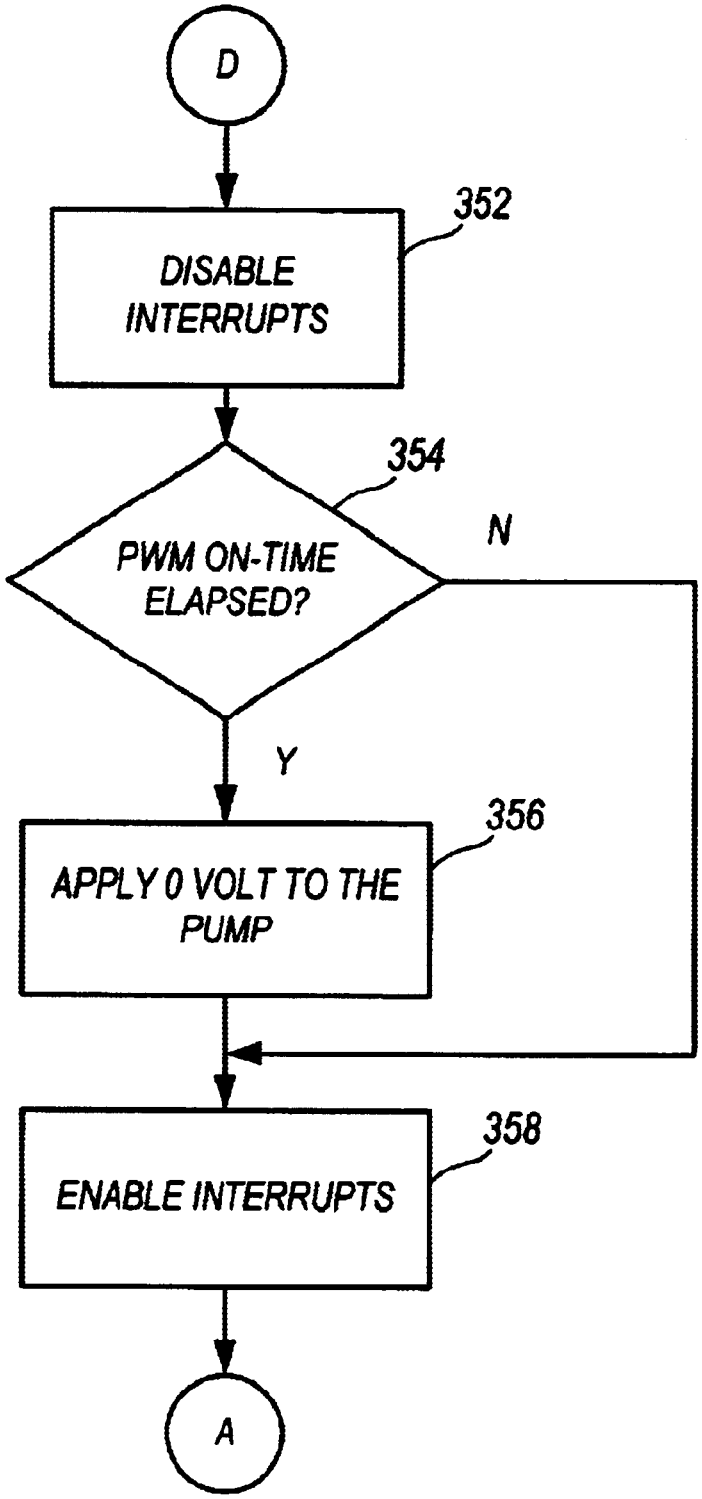

Referring to FIG. 21E, the microprocessor 278 first disables (at 352) an interrupt service routine (ISR), the operation of which will be described with respect to FIG. 21F, in order to start the PWM sequence. The microprocessor 278 then determines (at 354) whether the on-time for the PWM control signal (e.g., the +5V portion of the PWM control signal at pin 9) has elapsed. If the on-time has not elapsed, the microprocessor 278 continues providing a high control signal to the output power stage 216. If the on-time has elapsed, the microprocessor 278 applies (at 356) zero volts to the pump 10 (e.g., by turning off the transistor Q1, so that power is not provided to the pump 10). The microprocessor 278 then enables (at 358) the interrupt service routine that was disabled (at 352). Once the interrupt service routine is enabled, the microprocessor 278 returns to the beginning of the start pump sequence, as was shown and described with respect to FIG. 21B.

Figure 21F:
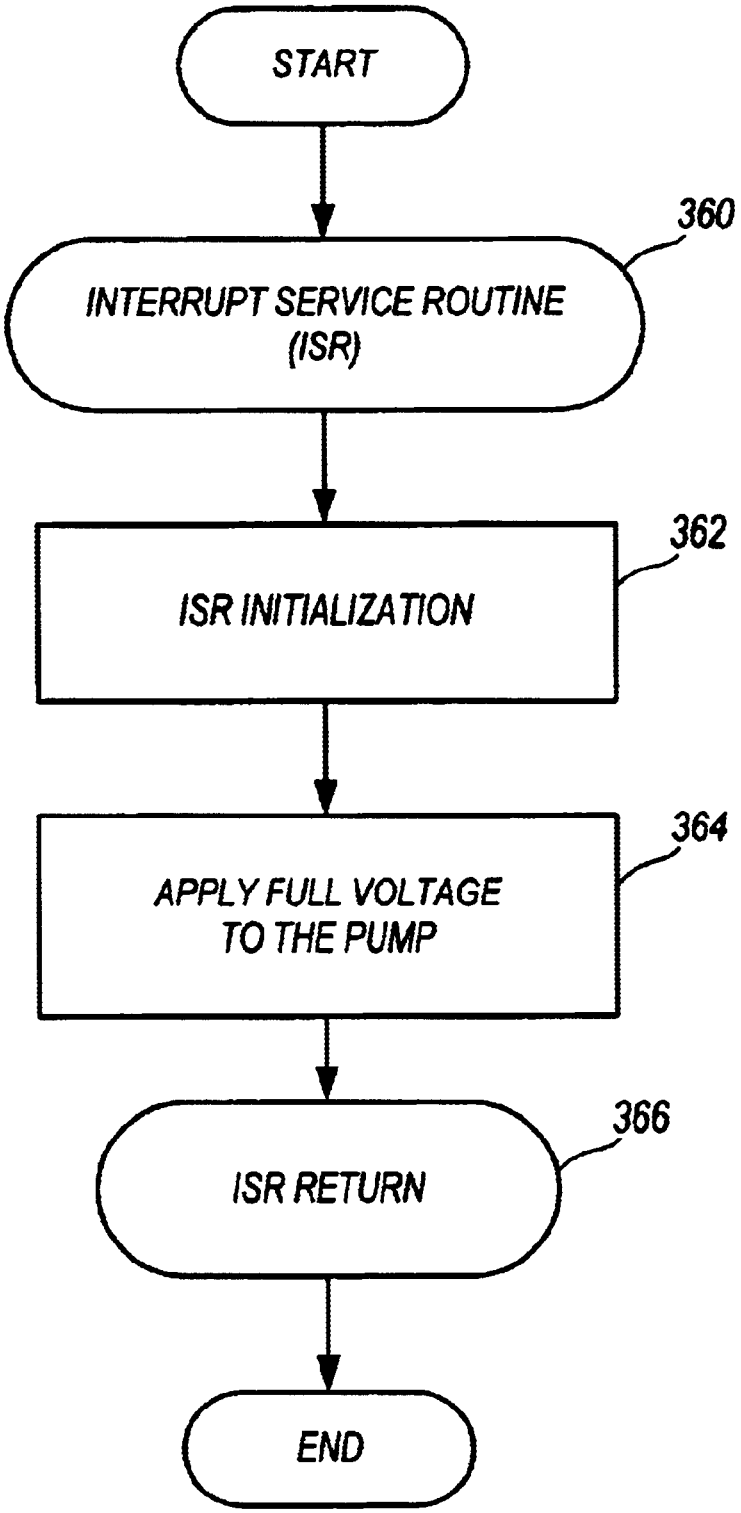

Referring to FIG. 21F, the microprocessor 278 runs (at 360) an interrupt service routine concurrently with the sequences of the pump shown and described with respect to FIGS. 21A–21E. The microprocessor 278 initializes (at 362) the interrupt service routine. The microprocessor 278 then applies (at 364) a full voltage to the pump 10 (e.g., by turning on the transistor Q1). Finally, the microprocessor returns (at 366) from the interrupt service routine to the sequences of the pump shown and described with respect to FIGS. 21A–21E. Preferably, the interrupt service routine is cycled every 1 msec in order to apply a full voltage to the pump 10 at a frequency of 1 kHz.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

We claim:

1. A pump comprising:

a housing having
- an inlet port;
- an outlet port;
- an inlet chamber in fluid communication with the inlet port;
- an outlet chamber in fluid communication with the outlet port; and
- a valve selectively separating the inlet chamber from the outlet chamber;

the outlet port positioned to receive fluid exiting tangentially from the outlet chamber.

2. The pump of claim 1, wherein the inlet chamber at least partially surrounds the outlet chamber.

3. The pump of claim 1, wherein the outlet chamber is generally in the shape of a pentagon, and wherein the outlet port is positioned tangentially with respect to a first side of the pentagon.

4. The pump of claim 1, wherein the inlet port is positioned tangentially with respect to a side of the outlet chamber.

5. The pump of claim 4, wherein the outlet port and the inlet port lie generally parallel to a side of the outlet chamber.

6. The pump of claim 1, further comprising a pressure sensor positioned within a perimeter of the outlet chamber.

7. The pump of claim 6, wherein the pressure sensor is positioned a distance from a center of the outlet chamber.

8. The pump of claim 6, wherein the pressure sensor is a silicon semiconductor pressure sensor.

9. A pump control circuit for use with a pump, the circuit comprising:

a pressure sensor capable of producing a signal representative of changes in pressure in the pump, the pressure sensor being a silicon semiconductor pressure sensor;

a microcontroller coupled to receive the signal from the pressure sensor, the microcontroller programmed to control the speed of the pump by generating a pulse-width modulation control signal; and an output power stage coupled to receive the control signal from the microcontroller and capable of controlling the application of power to the pump in response to the control signal.

10. The pump control circuit of claim 9, wherein the pressure sensor produces a signal representative of changes in the pressure in an outlet chamber in the pump.

11. The pump control circuit of claim 9, wherein the pulse-width modulation control signal has a duty cycle that is reduced in order to reduce the power supplied to the pump and that is increased in order to increase the power supplied to the pump.

12. The pump control circuit of claim 9, wherein an amplifier and filter circuit is coupled between the pressure sensor and the microprocessor.

13. A pump control circuit for use with a pump, the circuit comprising:

a pressure sensor capable of producing a signal representative of changes in pressure in the pump;

a microcontroller coupled to receive the signal from the pressure sensor, the microcontroller programmed to control the speed of the pump by generating a pulse-width modulation control signal;

an amplifier and filter circuit coupled between the pressure sensor and the microprocessor, the amplifier and filter circuit including a potentiometer used to calibrate the pressure sensor; and an output power stage coupled to receive the control signal from the microcontroller and capable of controlling the application of power to the pump in response to the control signal.

14. The pump control circuit of claim 13, wherein the output power stage includes a comparator circuit which determines whether the control signal is a high control signal or a low control signal, and wherein an output of the comparator circuit is positive for a high control signal and negative for a low control signal.

15. A pump control circuit for use with a pump, the circuit comprising:

a pressure sensor capable of producing a signal representative of changes in pressure in the pump;

a microcontroller coupled to receive the signal from the pressure sensor, the microcontroller programmed to control the speed of the pump by generating a pulse-width modulation control signal; and an output power stage coupled to receive the control signal from the microcontroller and capable of controlling the application of power to the pump in response to the control signal, the output power stage including a comparator circuit which determines whether the control signal is a high control signal or a low control signal, an output of the comparator circuit being positive for a high control signal and negative for a low control signal, and the comparator circuit having a gain approximately equal to the voltage of a battery connected to the pump control circuit.

16. A pump control circuit for use with a pump, the circuit comprising:

a pressure sensor capable of producing a signal representative of changes in pressure in the pump;

a microcontroller coupled to receive the signal from the pressure sensor, the microcontroller programmed to control the speed of the pump by generating a pulse-width modulation control signal; and an output power stage coupled to receive the control signal from the microcontroller and capable of controlling the application of power to the pump in response to the control signal, the output power stage including a comparator circuit which determines whether the control signal is a high control signal or a low control signal, an output of the comparator circuit being positive for a high control signal and negative for a low control signal, and the output power stage including a transistor coupled between the comparator circuit and the pump, wherein the transistor conducts power to the pump if the output of the comparator circuit is positive, and wherein the transistor does not conduct power to the pump if the output of the comparator circuit is negative.

17. The pump control circuit of claim 16, wherein the transistor is a metal-oxide semiconductor field-effect transistor.

18. The pump control circuit of claim 16, wherein the transistor is capable of operating at a frequency of 1 kHz.

19. The pump control circuit of claim 16, wherein the output power stage includes at least one diode coupled between the transistor and the pump in order to release inductive energy generated by the pump.

20. A pump control circuit for use with a pump, the circuit comprising:

an input power stage designed to be coupled to a battery;

a microcontroller coupled to the input power stage, the microcontroller programmed to sense the voltage of the battery and to generate a control signal if the voltage of the battery is below a high threshold and above a low threshold; and an output power stage coupled to receive the control signal from the microcontroller and capable of controlling the application of power to the pump in response to the control signal.

21. The pump control circuit of claim 20, wherein the battery is a standard automotive battery.

22. The pump control circuit of claim 21, wherein the high threshold is approximately 14 volts and the low threshold is approximately 8 volts.

23. The pump control circuit of claim 20, and further comprising a voltage divider circuit coupled between the input power stage and the microcontroller so that the voltage sensed by the microcontroller is a fraction of the voltage of the battery.

24. The pump control circuit of claim 20, wherein the output power stage includes a comparator circuit which determines whether the control signal is a high control signal or a low control signal, and wherein an output of the comparator circuit is positive for a high control signal and negative for a low control signal.

25. The pump control circuit of claim 24, wherein the comparator circuit has a gain approximately equal to the voltage of the battery.

26. The pump control circuit of claim 24, wherein the output power stage includes a transistor coupled between the comparator circuit and the pump, wherein the transistor conducts power to the pump if the output of the comparator circuit is positive, and wherein the transistor does not conduct power to the pump if the output of the comparator circuit is negative.

27. The pump control circuit of claim 26, wherein the transistor is a metal-oxide semiconductor field-effect transistor.

28. The pump control circuit of claim 26, wherein the transistor is capable of operating at a frequency of 1 kHz.

29. The pump control circuit of claim 26, wherein the output power stage includes at least one diode coupled between the transistor and the pump in order to release inductive energy generated by the pump.

30. A method of controlling a pump, the method comprising:

coupling a battery having a voltage to the pump;

sensing the voltage;

generating a control signal if the sensed voltage is below a high threshold and above a low threshold; and controlling the application of power to the pump in response to the control signal.

31. The method of claim 30, wherein coupling a battery having a voltage to the pump includes coupling a standard automotive battery having a voltage of approximately 13.6 volts to the pump.

32. The method of claim 31, wherein generating a control signal if the sensed voltage is below a high threshold and above a low threshold includes generating a control signal if the sensed voltage is below approximately 14 volts and above approximately 8 volts.

33. The method of claim 30, and further comprising determining whether the generated control signal is a high control signal or a low control signal, providing power to the pump if the control signal is a high control signal, and not providing power to the pump if the control signal is a low control signal.

34. A pump control circuit for use with a pump, the circuit comprising:

an input power stage designed to be coupled to a battery;

a pressure sensor capable of sensing a pressure in the pump;

a microcontroller coupled to the input power stage and the pressure sensor, the microcontroller programmed to sense the voltage of the battery and to determine a shut-off pressure based on the sensed voltage, and the microcontroller programmed to generate a high control signal if the sensed pressure is less than the shut-off pressure and a low control signal if the sensed pressure is greater than the shut-off pressure; and an output power stage coupled to receive the control signal from the microcontroller so that the output power stage provides power to the pump if the control signal is a high control signal and does not provide power to the pump if the control signal is a low control signal.

35. The pump control circuit of claim 34, wherein the battery is a standard automotive battery.

36. The pump control circuit of claim 34, and further comprising a voltage divider circuit coupled between the input power stage and the microcontroller so that the voltage sensed by the microcontroller is a fraction of the voltage of the battery.

37. The pump control circuit of claim 34, wherein the pressure sensor is capable of sensing a pressure in an outlet chamber in the pump.

38. The pump control circuit of claim 34, wherein the pressure sensor is a silicon semiconductor pressure sensor.

39. The pump control circuit of claim 34, wherein an amplifier and filter circuit is coupled between the pressure sensor and the microprocessor.

40. The pump control circuit of claim 39, wherein the amplifier and filter circuit includes a potentiometer used to calibrate the pressure sensor.

41. The pump control circuit of claim 34, wherein the output power stage includes a comparator circuit which determines whether the control signal is a high control signal or a low control signal, and wherein an output of the comparator circuit is positive for a high control signal and negative for a low control signal.

42. The pump control circuit of claim 41, wherein the comparator circuit has a gain approximately equal to the voltage of the battery.

43. The pump control circuit of claim 41, wherein the output power stage includes a switch coupled between the comparator circuit and the pump, wherein the switch conducts power to the pump if the output of the comparator circuit is positive, and wherein the switch does not conduct power to the pump if the output of the comparator circuit is negative.

44. The pump control circuit of claim 43, wherein the switch is a metal-oxide semiconductor field-effect transistor.

45. The pump control circuit of claim 43, wherein the switch is capable of operating at a frequency of 1 kHz.

46. The pump control circuit of claim 43, wherein the output power stage includes at least one diode coupled between the transistor and the pump in order to release inductive energy generated by the pump.

47. A method of controlling a pump, the method comprising:

coupling a battery having a voltage to the pump;

sensing the voltage;

determining a shut-off pressure based on the sensed voltage;

sensing a pressure in the pump;

comparing the sensed pressure to the shut-off pressure; and providing power to the pump if the sensed pressure is less than the shut-off pressure and not providing power to the pump if the sensed pressure is greater than the shut-off pressure.

48. The method of claim 47, wherein coupling a battery having a voltage to the pump includes coupling a standard automotive battery having a voltage of approximately 13.6 volts to the pump.

49. The method of claim 47, wherein sensing a pressure in the pump includes sensing a pressure in an outlet chamber in the pump.

50. The method of claim 47, and further comprising amplifying and filtering the sensed pressure before comparing the sensed pressure to the shut-off pressure.

51. A pump control circuit for use with a pump, the circuit comprising:

a pressure sensor capable of sensing a pressure in the pump the pressure sensor being a silicon semiconductor pressure sensor;

a current sensing circuit capable of sensing a current being provided to the pump;

a microcontroller coupled to the pressure sensor and the current sensing circuit, the microcontroller programmed to determine a current limit threshold based on the sensed pressure, and the microcontroller programmed to generate a high control signal if the sensed current is less than the current limit threshold and a low control signal if the sensed current is greater than the current limit threshold; and an output power stage coupled to receive the control signal from the microcontroller so that if the control signal is a low control signal the power provided to the pump is reduced until the sensed current is less than the current limit threshold.

52. The pump control circuit of claim 51, wherein the pressure sensor is capable of sensing the pressure in an outlet chamber in the pump.

53. The pump control circuit of claim 51, wherein an amplifier and filter circuit is coupled between the pressure sensor and the microprocessor.

54. A pump control circuit for use with a pump, the circuit comprising:

a pressure sensor capable of sensing a pressure in the pump;

a current sensing circuit capable of sensing a current being provided to the pump;

a microcontroller coupled to the pressure sensor and the current sensing circuit, the microcontroller programmed to determine a current limit threshold based on the sensed pressure, and the microcontroller programmed to generate a high control signal if the sensed current is less than the current limit threshold and a low control signal if the sensed current is greater than the current limit threshold;

an amplifier and filter circuit coupled between the pressure sensor and the microprocessor the amplifier and filter circuit including a potentiometer used to calibrate the pressure sensor; and an output power stage coupled to receive the control signal from the microcontroller so that if the control signal is a low control signal the power provided to the pump is reduced until the sensed current is less than the current limit threshold.

55. The pump control circuit of claim 54, wherein the output power stage includes a comparator circuit which determines whether the control signal is a high control signal or a low control signal, and wherein an output of the comparator circuit is positive for a high control signal and negative for a low control signal.

56. A pump control circuit for use with a pump, the circuit comprising:

a pressure sensor capable of sensing a pressure in the pump;

a current sensing circuit capable of sensing a current being provided to the pump;

a microcontroller coupled to the pressure sensor and the current sensing circuit, the microcontroller programmed to determine a current limit threshold based on the sensed pressure, and the microcontroller programmed to generate a high control signal if the sensed current is less than the current limit threshold and a low control signal if the sensed current is greater than the current limit threshold; and an output power stage coupled to receive the control signal from the microcontroller so that if the control signal is a low control signal the power provided to the pump is reduced until the sensed current is less than the current limit threshold, the output power stage including a comparator circuit which determines whether the control signal is a high control signal or a low control signal, an output of the comparator circuit being positive for a high control signal and negative for a low control signal, and the comparator circuit having a gain approximately equal to the voltage of a battery connected to the pump control circuit.

57. A pump control circuit for use with a pump, the circuit comprising:

a pressure sensor capable of sensing a pressure in the pump;

a current sensing circuit capable of sensing a current being provided to the pump;

a microcontroller coupled to the pressure sensor and the current sensing circuit, the microcontroller programmed to determine a current limit threshold based on the sensed pressure, and the microcontroller programmed to generate a high control signal if the sensed current is less than the current limit threshold and a low control signal if the sensed current is greater than the current limit threshold; and an output power stage coupled to receive the control signal from the microcontroller so that if the control signal is a low control signal the power provided to the pump is reduced until the sensed current is less than the current limit threshold, the output power stage including a comparator circuit which determines whether the control signal is a high control signal or a low control signal, an output of the comparator circuit being positive for a high control signal and negative for a low control signal, and the output power stage including a switch coupled between the comparator circuit and the pump, wherein the switch conducts power to the pump if the output of the comparator circuit is positive, and wherein the switch does not conduct power to the pump if the output of the comparator circuit is negative.

58. The pump control circuit of claim 57, wherein the switch is a metal-oxide semiconductor field-effect transistor.

59. The pump control circuit of claim 57, wherein the switch is capable of operating at a frequency of 1 kHz.

60. The pump control circuit of claim 57, wherein the output power stage includes at least one diode coupled between the transistor and the pump in order to release inductive energy generated by the pump.

61. A method of controlling a pump, the method comprising:

sensing a pressure in the pump;

determining a current limit threshold based on the sensed pressure;

sensing a current being provided to the pump;

comparing the sensed current to the current limit threshold;

providing power to the pump if the sensed current is less than the current limit threshold and reducing the power provided to the pump if the sensed current is greater than the current limit threshold until the sensed current is less than the current limit threshold; and coupling a standard automotive battery having a voltage of approximately 13.6 volts to the pump.

62. A method of controlling a pump, the method comprising:

sensing a pressure in an outlet chamber in the pump;

determining a current limit threshold based on the sensed pressure;

sensing a current being provided to the pump, comparing the sensed current to the current limit threshold; and providing power to the pump if the sensed current is less than the current limit threshold and reducing the power provided to the pump if the sensed current is greater than the current limit threshold until the sensed current is less than the current limit threshold.

63. A method of controlling a pump, the method comprising:

sensing a pressure in the pump;

determining a current limit threshold based on the sensed pressure;

sensing a current being provided to the pump;

comparing the sensed current to the current limit threshold;

providing power to the pump if the sensed current is less than the current limit threshold and reducing the power provided to the pump if the sensed current is greater than the current limit threshold until the sensed current is less than the current limit threshold; and amplifying and filtering the sensed pressure before comparing the sensed pressure to the shut-off pressure.

* * * * *